US005942362A

United States Patent [19]

Tadokoro et al.

[11] Patent Number: 5,942,362

[45] Date of Patent: Aug. 24, 1999

[54] ELECTROPHOTOGRAPHIC PHOTOCONDUCTOR

[75] Inventors: Kaoru Tadokoro; Masayuki Shoshi; Michihiko Namba, all of Kanagawa, Japan

[73] Assignee: Ricoh Company, Ltd., Tokyo, Japan

[21] Appl. No.: 08/960,593

[22] Filed: Oct. 30, 1997

[30] Foreign Application Priority Data

| | | | |
|---|---|---|---|
| Oct. 30, 1996 | [JP] | Japan | 8-304018 |
| Nov. 1, 1996 | [JP] | Japan | 8-307393 |
| Jan. 28, 1997 | [JP] | Japan | 9-043124 |
| Jul. 8, 1997 | [JP] | Japan | 9-197916 |

[51] Int. Cl.[6] ..... G03G 5/047; G03G 5/04

[52] U.S. Cl. ..... 430/59; 430/56; 430/58; 430/83

[58] Field of Search ..... 430/56, 58, 59, 430/83

[56] References Cited

U.S. PATENT DOCUMENTS

| | | | |
|---|---|---|---|
| 4,932,860 | 6/1990 | Yoshihara et al. | 430/83 |
| 5,096,793 | 3/1992 | Osawa et al. | 430/58 |
| 5,380,613 | 1/1995 | Ueda et al. | 430/58 |
| 5,474,868 | 12/1995 | Adachi et al. | 430/59 |
| 5,618,846 | 4/1997 | Nogami et al. | 430/83 |
| 5,702,855 | 12/1997 | Ikegami et al. | 430/56 |

*Primary Examiner*—Roland Martin
*Attorney, Agent, or Firm*—Oblon, Spivak, McClelland, Maier & Neustadt, P.C.

[57] ABSTRACT

An electrophotographic photoconductor has an electroconductive support and a photoconductive layer provided thereon, containing at least one phenol compound of formula (1):

(1)

wherein $R^1$ to $R^4$ and $R^{11}$ to $R^{14}$ are each independently a hydrogen atom, an alkyl group which may have a substituent, an alkoxyl group which may have a substituent, an alkoxycarbonyl group which may have a substituent, an aryl group which may have a substituent, nitro group, cyano group or a halogen atom; and Y is in which R is a hydrogen atom, an alkyl group which may have a substituent, an alkoxyl group which may have a substituent, an alkoxycarbonyl group which may have a substituent, an aryl group which may have a substituent, nitro group, cyano group, hydroxyl group or a halogen atom, and n is an integer of 0 to 5, or $—(CH{=}CH)_x—$, in which x is an integer of 0 to 5.

23 Claims, 2 Drawing Sheets

ELECTROPHOTOGRAPHIC PHOTOCONDUCTOR

BACKGROUND OF THE INVENTION

1. Field of the Invention

The present invention relates to an electrophotographic photoconductor for use in the copying machines and printers employing the electrophotographic process, and more particularly to an electrophotographic photoconductor comprising a photoconductive layer which contains a specific phenol compound.

2. Discussion of Background

Inorganic compounds such as selenium, selenium tellurium alloy and arsenic selenium are conventionally used as photoconductive materials for use in the electrophotographic photoconductor. However, such inorganic photoconductive materials have toxicity, thereby causing the environmental problems. In addition, the properties of the above-mentioned inorganic photoconductive materials tend to readily deteriorate. This is because, for instance, selenium, which is in an amorphous condition when used as the photoconductive material, easily tends to crystallize when inappropriately heated or stained with dirt. Further, such inorganic photoconductive materials must be formed into a thin film with a thickness of several tens of micrometers by vacuum deposition, thereby increasing the manufacturing cost of the photoconductor.

To solve the above-mentioned problems of the inorganic photoconductive materials, electrophotographic photoconductors using the organic photoconductive materials have been actively developed in recent years, and many organic photoconductors have been put into practice.

The electrophotographic photoconductors employing the organic photoconductive materials have the advantages that the manufacturing cost is cheap and the mass-production is possible. However, the photoconductive layer comprising such organic photoconductive materials tends to easily deteriorate during the repeated electrophotographic process. To be more specific, the electrophotographic process includes the steps of charging the surface of the photoconductor by corona charging and exposing the photoconductor to light images to form latent electrostatic images thereon. Then, the latent electrostatic images formed on the surface of the photoconductor are developed with a toner, and the developed toner images are transferred to a sheet of paper. In addition, the residual toner remaining on the photoconductor after the transfer step is removed therefrom by the cleaning step. As mentioned above, various external forces are chemically and mechanically applied to the surface of the photoconductor. As a result, the electrostatic properties of the photoconductive layer are caused to deteriorate, and the surface of the photoconductor is easily worn out and scratched. Therefore, the organic photoconductor is required to have sufficient durability to cope with the above-mentioned applied chemical and mechanical external forces.

To protect the surface of the photoconductor from the mechanical force, the method of adding a lubricant to a surface layer and a protective layer of the photoconductor to decrease the coefficient of friction of the surface portion thereof is considered to be effective, as disclosed in Japanese Laid-Open Patent Applications 52-117134 and 63-61256.

Further, when the electrophotographic photoconductor is repeatedly subjected to the electrophotographic process, the charging potential and the sensitivity are decreased and the residual potential is increased. The above-mentioned problems are caused by the influence of gases such as ozone and nitric oxide ($NO_x$) generated by the corona charging in the course of the charging step.

To solve the above-mentioned problems, it is proposed to add a particular antioxidant to the photoconductive layer and the protective layer provided on the photoconductive layer, for example, as disclosed in Japanese Laid-Open Patent Applications 4-184455, 6-175381 and 3-188456. However, satisfactory results cannot be obtained by the addition of such conventional antioxidants.

In recent years, the copying machine is required to produce high quality images and be provided with text editing function and composite processing function. In line with the above-mentioned demands, non-impact printing technology has been developed and digital recording apparatuses such as a laser printer, laser facsimile machine and digital copying machine have been widely utilized.

Most of the above-mentioned digital recording apparatuses employ as a light source semiconductor laser because it is compact, cheap and convenient. The wavelength of the currently used semiconductor laser beam is limited to the range of the near infrared rays of 750 nm or more, so that the electrophotographic photoconductors used in the above-mentioned digital recording apparatuses are required to show sufficient photosensitivity in the wavelength range of at least 750 to 850 nm.

It is conventionally known that the organic photoconductive materials, for example, a phthalocyanine pigment, azo pigment, cyanine pigment, azulene pigment, and squarylium pigment can show the photosensitivity in the above-mentioned wavelength range. In particular, the phthalocyanine pigment can show absorption and photosensitivity in the relatively long wavelength range. In addition, a variety of phthalocyanine pigments can be obtained according to the kind of central metal or the type of crystalline form. Therefore, research and development of the phthalocyanine pigment has been actively conducted to cope with the semiconductor laser for use in the electrophotographic photoconductor.

There are conventionally known $\epsilon$-type copper phthalocyanine, X-type metal-free phthalocyanine, $\tau$-type metal-free phthalocyanine, vanadyl phthalocyanine and oxytitanyl phthalocyanine. Any of the above-mentioned phthalocyanine compounds are still insufficient in terms of photosensitivity, chargeability, and the durability in the repeated use.

To eliminate the shortcomings of the above-mentioned conventional phthalocyanine compounds, oxytitanyl phthalocyanine pigments provided with high photosensitivity are proposed, as disclosed in Japanese Laid-Open Patent Application 59-49544 (U.S. Pat. No. 4,444,861), Japanese Laid-Open Patent Application 59-166959, Japanese Laid-Open Patent Application 61-239248 (U.S. Pat. No. 4,728,592), Japanese Laid-Open Patent Application 62-67094 (U.S. Pat. No. 4,664,997), Japanese Laid-Open Patent Application 62-275272, Japanese Laid-Open Patent Application 63-366, Japanese Laid-Open Patent Application 63-116158, Japanese Laid-Open Patent Application 63-198067, Japanese Laid-Open Patent Application 64-17066, Japanese Laid-Open Patent Application 2-28265, Japanese Laid-Open Patent Application 3-35064, and Japanese Laid-Open Patent Application 3-200790.

In the electrophotographic photoconductor, all the charge transport materials do not always show good performance when used in combination with a specific charge generation material. Namely, there is a preferable combination of a charge transport material and an additive such as an antioxidant with the specific charge generation material. If those materials are improperly used in combination, there occur many problems, for example, decrease of the photosensitivity, increase of the residual potential, and deterioration of the charging stability.

According to Japanese Laid-Open Patent Applications 1-82043, 2-136862 and 2-189555, preferable combinations of the above-mentioned oxytitanyl phthalocyanine pigment with the specific charge transport materials are proposed. However, any electrophotographic photoconductors are still unsatisfactory in terms of the photosensitivity, residual potential and the charging stability in the repeated use.

SUMMARY OF THE INVENTION

It is therefore a first object of the present invention to provide an electrophotographic photoconductor with such excellent resistance to reactive gases as to prevent the decrease of charging potential and photosensitivity and the increase of residual potential.

A second object of the present invention is to provide an electrophotographic photoconductor which is capable of showing good photosensitivity with respect to a light source with a long wavelength, and in particular, suitable for the recording apparatuses such as a copying machine and printer, employing the semiconductor laser beam as a light source.

A third object of the present invention is to provide an electrophotographic photoconductor with such excellent durability as to minimize the increase of residual potential and to prevent the variation of charging potential even though a specific material such as an oxytitanyl phthalocyanine pigment is used as the charge generation material.

A fourth object of the present invention is to provide a phenol compound capable of serving as an excellent antioxidant, for instance, when used in the electrophotographic photoconductor.

The above-mentioned first to third objects of the present invention can be attained by an electrophotographic photoconductor comprising an electroconductive support and a photoconductive layer formed thereon, comprising at least one phenol compound of formula (1):

(1)

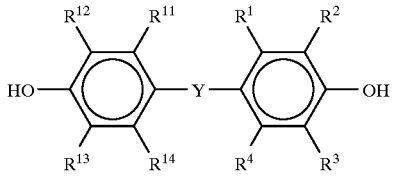

wherein $R^1$ to $R^4$ and $R^{11}$ to $R^{14}$ are each independently a hydrogen atom, an alkyl group which may have a substituent, an alkoxyl group which may have a substituent, an alkoxycarbonyl group which may have a substituent, an aryl group which may have a substituent, nitro group, cyano group or a halogen atom; and Y is

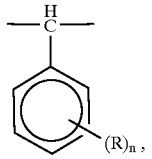

in which R is a hydrogen atom, an alkyl group which may have a substituent, an alkoxyl group which may have a substituent, an alkoxycarbonyl group which may have a substituent, an aryl group which may have a substituent, nitro group, cyano group, hydroxyl group or a halogen atom, and n is an integer of 0 to 5, or $—(CH{=}CH)_x—$, in which x is an integer of 0 to 5.

The above-mentioned fourth object of the present invention can be achieved by a phenol compound of formula (2):

(2)

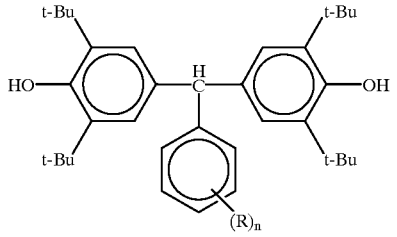

wherein R is a hydrogen atom, an alkyl group which may have a substituent, an alkoxyl group which may have a substituent, an alkoxycarbonyl group which may have a substituent, an aryl group which may have a substituent, nitro group, cyano group, hydroxyl group, or a halogen atom; and n is an integer of 0 to 5.

Alternatively, the fourth object can be attained by a phenol compound of formula (3):

(3)

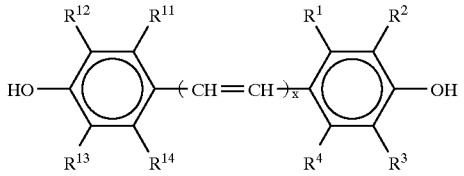

wherein $R^1$ to $R^4$ and $R^{11}$ to $R^{14}$ are each a hydrogen atom, an alkyl group which may have a substituent, an alkoxyl group which may have a substituent, an alkoxycarbonyl group which may have a substituent, an aryl group which may have a substituent, nitro group, cyano group, or a halogen atom; and x is an integer of 0 to 5.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
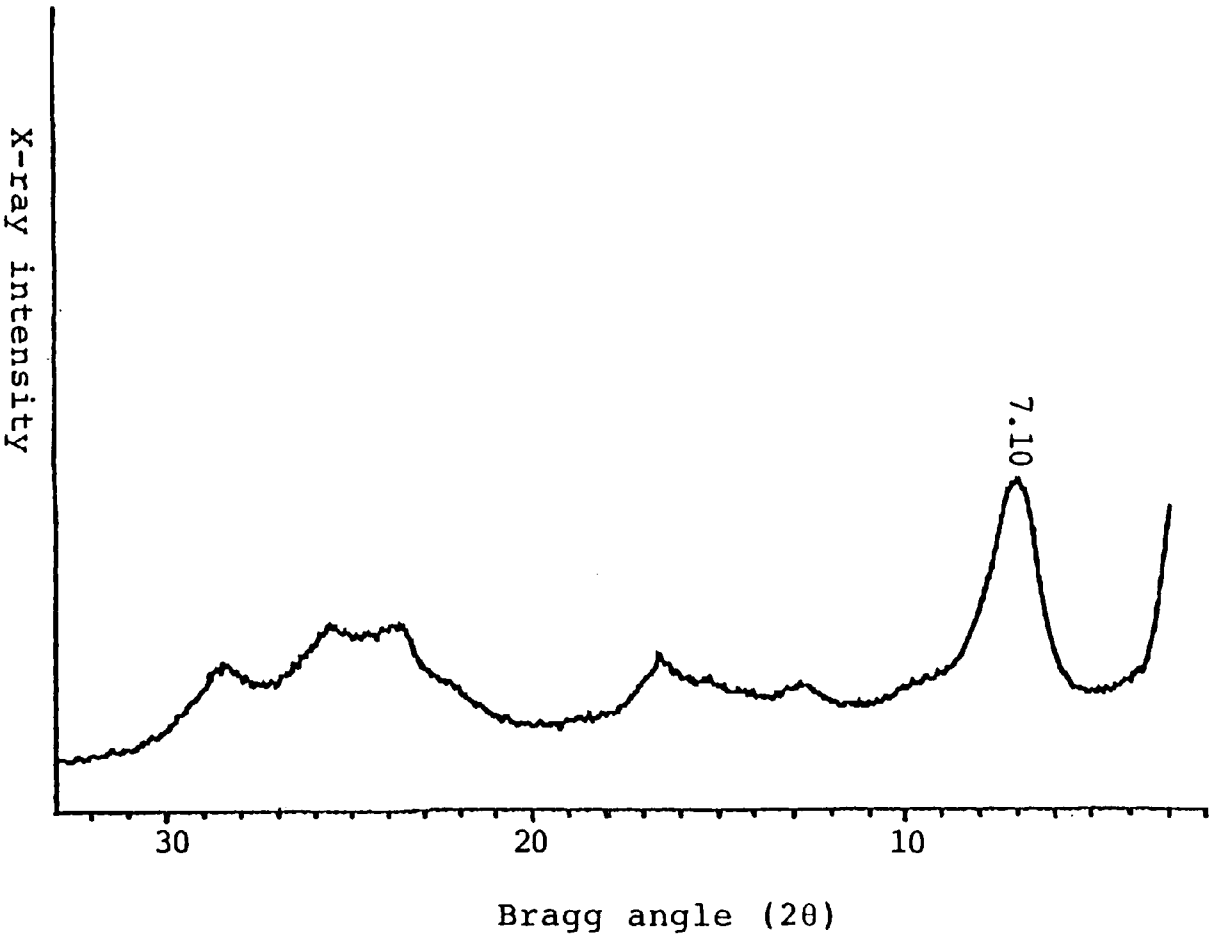
FIG. 1 is an X-ray diffraction spectrum of an amorphous oxytitanyl phthalocyanine pigment obtained in Reference Example 1.

According to the present invention, the anti-oxidant action of a phenol compound of formula (1) is excellent, so that when the phenol compound of formula (1) is contained in a photoconductive layer of the electrophotographic photoconductor, the environmental resistance, in particular, the resistance to reactive gases, of the obtained photoconductor is remarkably improved. As a result, the decrease of charging potential and photosensitivity and the increase of residual potential can be prevented effectively.

In the formula (1), $R^1$ to $R^4$, and $R^{11}$ to $R^{14}$ are as follows:

(a) a hydrogen atom.

(b) a halogen atom, such as fluorine atom or chlorine atom.

(c) an alkyl group having 1 to 9 carbon atoms, such as methyl group, ethyl group, propyl group, n-butyl group or t-butyl group. The above-mentioned alkyl group may have a substituent such as a halogen atom, for example, fluorine atom or chlorine atom.

(d) an alkoxyl group having 1 to 9 carbon atoms, such as methoxy group or ethoxy group. The above-mentioned alkoxyl group may have a substituent such as a halogen atom, for example, fluorine atom or chlorine atom.

(e) an alkoxycarbonyl group having 1 to 9 carbon atoms, such as methoxycarbonyl group or ethoxycarbonyl group. The above-mentioned alkoxycarbonyl group may have a substituent such as a halogen atom, for example, fluorine atom or chlorine atom.

(f) nitro group.

(g) cyano group.

(h) an aryl group such as phenyl group or naphthyl group, which may have a substituent.

Examples of the substituents for the above-mentioned aryl group include a halogen atom such as fluorine atom or chlorine atom; an alkyl group such as methyl group, ethyl group, propyl group, n-butyl group or t-butyl group, which alkyl group may have a halogen atom such as fluorine atom or chlorine atom as a substituent; and an alkoxyl group such as methoxy group or ethoxy group.

In the formula (1), Y represents:

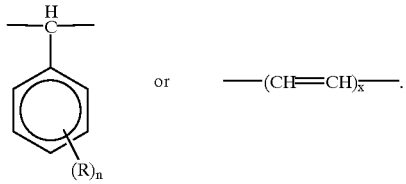

In the above, R is as follows:

(a) a hydrogen atom.

(b) a halogen atom, such as fluorine atom or chlorine atom.

(c) an alkyl group having 1 to 9 carbon atoms, such as methyl group, ethyl group, propyl group, n-butyl group or t-butyl group. The above-mentioned alkyl group may have a substituent such as a halogen atom, for example, fluorine atom or chlorine atom.

(d) an alkoxyl group having 1 to 9 carbon atoms, such as methoxy group or ethoxy group. The above-mentioned alkoxyl group may have a substituent such as a halogen atom, for example, fluorine atom or chlorine atom.

(e) an alkoxycarbonyl group having 1 to 9 carbon atoms, such as methoxycarbonyl group or ethoxycarbonyl group. The above-mentioned alkoxycarbonyl group may have a substituent such as a halogen atom, for example, fluorine atom or chlorine atom.

(f) nitro group.

(g) cyano group.

(h) hydroxyl group.

(i) an aryl group such as phenyl group or naphthyl group, which may have a substituent such as a halogen atom.

In the present invention, it is preferable to employ a phenol compound represented by the following formula (2) or (3):

[Phenol compound of formula (2)]

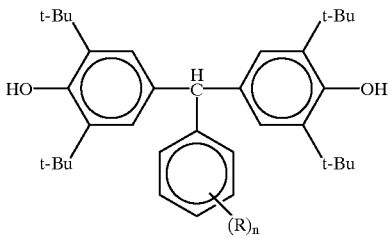

(2)

wherein R is a hydrogen atom, an alkyl group which may have a substituent, an alkoxyl group which may have a substituent, an alkoxycarbonyl group which may have a substituent, an aryl group which may have a substituent, nitro group, cyano group, hydroxyl group, or a halogen atom; and n is an integer of 0 to 5.

[Phenol compound of formula (3)]

(3)

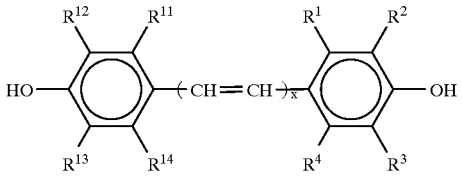

wherein $R^1$ to $R^4$ and $R^{11}$ to $R^{14}$ are each a hydrogen atom, an alkyl group which may have a substituent, an alkoxyl group which may have a substituent, an alkoxycarbonyl group which may have a substituent, an aryl group which may have a substituent, nitro group, cyano group, or a halogen atom; and x is an integer of 0 to 5.

The above-mentioned phenol compound of formula (2) can be easily obtained by allowing a corresponding phenol compound (A) to react with an aldehyde compound (B) in the presence of an acidic catalyst such as sulfuric acid or titanium tetrachloride in accordance with the following reaction scheme (a):

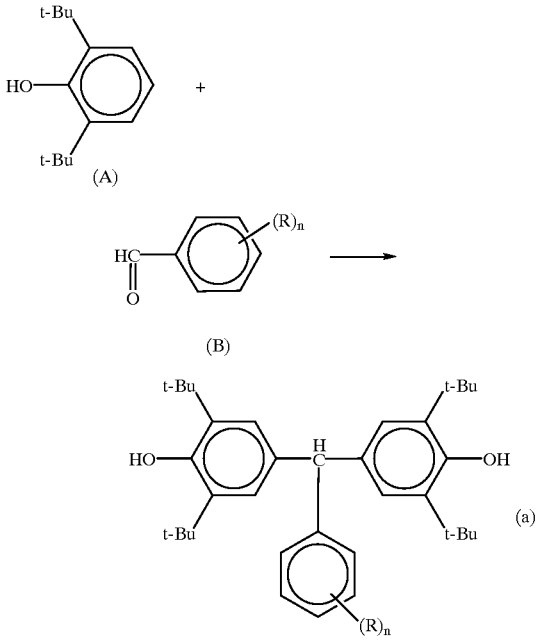

Specific examples of the phenol compound represented by the formula (2) are shown in Table 1.

TABLE 1

(2)

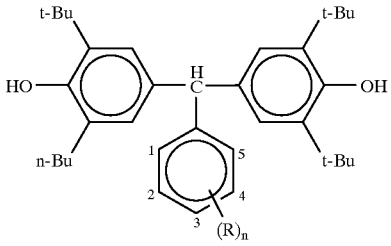

| Phenol Compound No. | n | R |
|---|---|---|
| 1 | 0 | H |
| 2 | 1 | 1-$CH_3$ |
| 3 | 1 | 2-$CH_3$ |
| 4 | 1 | 3-$CH_3$ |
| 5 | 1 | 1-CN |
| 6 | 1 | 2-CN |
| 7 | 1 | 3-CN |
| 8 | 1 | 3-$CF_3$ |
| 9 | 1 | 2-$CF_3$ |
| 10 | 1 | 1-$CF_3$ |
| 11 | 1 | 3-$NO_2$ |
| 12 | 1 | 3-$COOCH_3$ |
| 13 | 1 | 3-$COOC_4H_9$ |
| 14 | 1 | 3-$C_2H_5$ |
| 15 | 1 | 2-Cl |
| 16 | 1 | 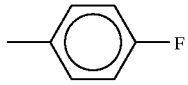 |
| 17 | 1 | 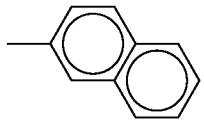 |
| 18 | 3 | 3-OH, 2-tert-Bu 4-tert-Bu |
| 19 | 1 | 2-$CH_3$ |
| 20 | 1 | 1-$CH_3$ |
| 21 | 1 | 3-$CH_3$ |
| 22 | 2 | 2-$CH_3$, 4-$CH_3$ |
| 23 | 2 | 1-Cl, 3-Cl |
| 24 | 1 | 3-$COOC_4F_9$ |
| 25 | 1 | 1-$OC_2F_5$ |
| 26 | 1 | 3-$C_2H_5$ |
| 27 | 1 | 2-$OCH_3$ |
| 28 | 1 | 1-$OCH_3$ |

The phenol compound of formula (3) can be obtained by the following method.

Corresponding two phenol compounds are allowed to react with each other in the presence of an oxidizing agent to synthesize an intermediate in accordance with the following reaction scheme (b):

(b)

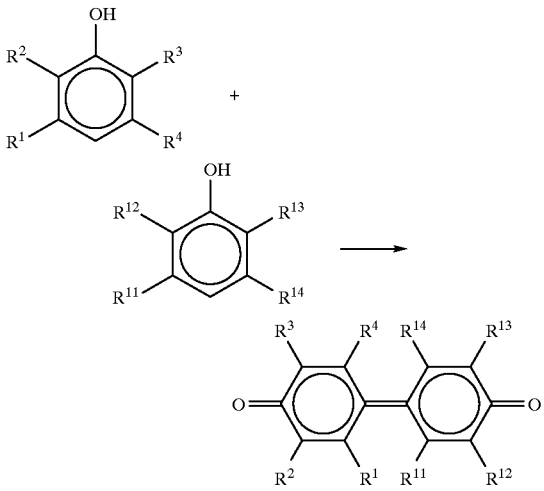

The above-mentioned reaction can be carried out without any solvent, or in a halogenated solvent such as chloroform or dichloroethane. It is preferable that the reaction temperature be in the range of 0 to 100° C.

Alternatively, an intermediate for the preparation of the phenol compound of formula (3) which has a conjugated chain can be obtained from the corresponding phenol compounds in accordance with the following reaction scheme (c), as described in J. Org. Chem., 36. 1339 (1971):

(c)

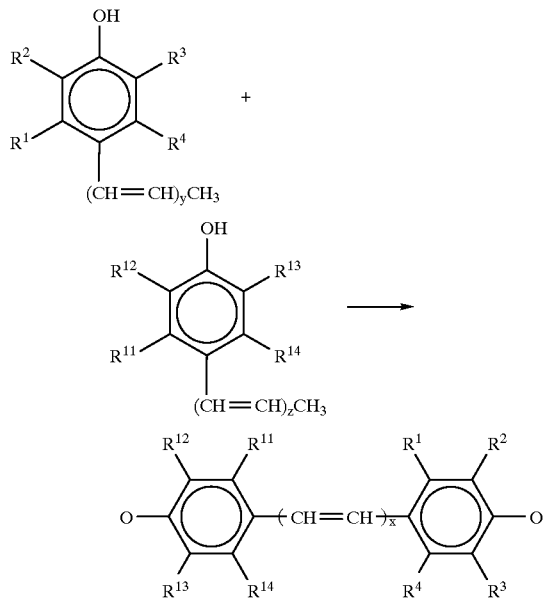

wherein y and z are each an integer of 0 to 4; and x=y+z+1.

The above-mentioned reaction represented by the reaction scheme (c) may be carried out without any solvent, or in an aromatic solvent such as benzene or toluene or a halogenated solvent such as chloroform or dichloroethane. The reaction temperature may be in the range of 0 to 200° C., and it is preferable to carry out the reaction under reflux by the application of heat. When a catalyst such as silver carbonate is used in the reaction, a desired intermediate product can be obtained in high yield.

The phenol compound of formula (3) is obtained by reducing the above prepared intermediate in the presence of a catalyst such as hydrosulfite in accordance with the following reaction scheme (d):

(d)

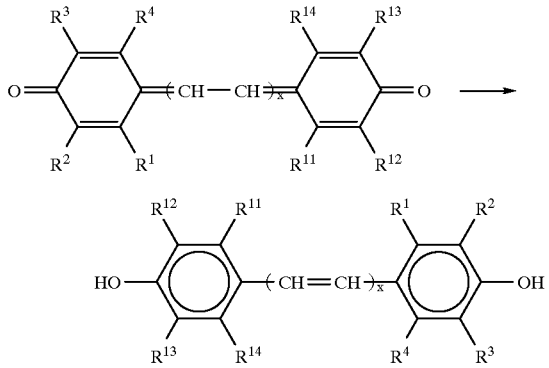

The above-mentioned reaction represented by the reaction scheme (d) may be carried out without any solvent; or in an ether solvent such as ethylene glycol dimethyl ether or diisopropyl ether, a halogenated solvent such as dichloromethane, dichloroethane or chloroform, an aromatic solvent such as benzene or toluene, or water. The reaction temperature may be in the range of 0 to 100° C. When an alkaline catalyst such as sodium hydroxide is used in the reaction, a desired phenol compound of formula (3) can be obtained in high yield.

Specific examples of the phenol compound represented by the formula (3) are shown in Tables 2-1 and 2-2.

TABLE 2-1

(3)

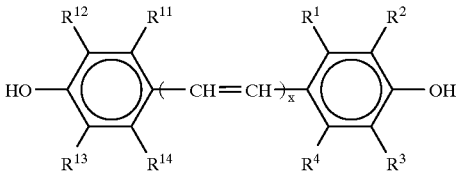

| Phenol Comp. No. | $R^1$ | $R^2$ | $R^3$ | $R^4$ | $R^{11}$ | $R^{12}$ | $R^{13}$ | $R^{14}$ | X |
|---|---|---|---|---|---|---|---|---|---|
| 101 | H | Me | Me | H | H | Me | Me | H | 0 |
| 102 | H | t-Bu | t-Bu | H | H | t-Bu | t-Bu | H | 0 |
| 103 | H | Me | Me | H | H | t-Bu | t-Bu | H | 0 |
| 104 | H | isopropyl | isopropyl | H | H | isopropyl | isopropyl | H | 0 |
| 105 | H | Ph | Ph | H | H | Ph | Ph | H | 0 |
| 106 | H | t-Bu | H | H | H | H | t-Bu | H | 0 |
| 107 | H | t-Bu | t-Bu | H | H | t-Bu | t-Bu | H | 0 |

TABLE 2-1-continued (3)

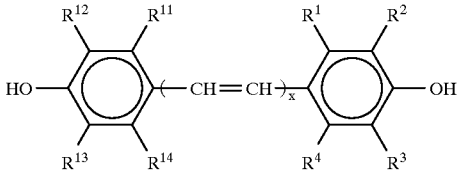

| Phenol Comp. No. | $R^1$ | $R^2$ | $R^3$ | $R^4$ | $R^{11}$ | $R^{12}$ | $R^{13}$ | $R^{14}$ | X |
|---|---|---|---|---|---|---|---|---|---|
| 108 | H | CCOBu | H | H | H | COOBu | H | H | 0 |
| 109 | H | Cl | Cl | H | H | Cl | Cl | H | 0 |
| 110 | H | $CF_3$ | $CF_3$ | H | H | $CF_3$ | $CF_3$ | H | 0 |
| 111 | $CF_3$ | H | H | $CF_3$ | $CF_3$ | H | H | $CF_3$ | 0 |
| 112 | H | Et | Et | H | H | Et | Et | H | 1 |
| 113 | H | OMe | OMe | H | H | OMe | OMe | H | 0 |
| 114 | H | $NO_2$ | $NO_2$ | H | H | $NO_2$ | $NO_2$ | H | 1 |
| 115 | H | CN | CN | H | H | CN | CN | H | 1 |
| 116 | H | OBu | OBu | H | H | OBu | OBu | H | 1 |
| 117 | H | COOMe | COOMe | H | H | COOMe | COOMe | H | 1 |
| 118 | H | $CF_3$ | $CF_3$ | H | H | $CF_3$ | $CF_3$ | H | 0 |
| 119 | $CF_3$ | H | H | $CF_3$ | $CF_3$ | H | H | $CF_3$ | 0 |
| 120 | H | COOBu | COOBu | H | H | COOBu | COOBu | H | 0 |
| 121 | H | COOBu | COOBu | H | H | COOBu | COOBu | H | 1 |
| 122 | H | CN | CN | H | H | CN | CN | H | 0 |

30

TABLE 2-2

| Phenol Comp. No. | $R^1$, $R^{11}$ | $R^2$, $R^{12}$ | $R^3$, $R^{13}$ | $R^4$, $R^{14}$ | X |
|---|---|---|---|---|---|
| 123 | H | 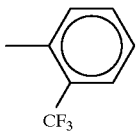  | 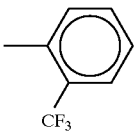  | H | 0 |
| 124 | H | 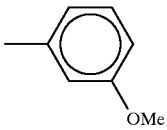  | 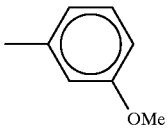  | H | 0 |
| 125 | 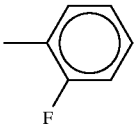  | H | H | 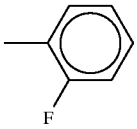  | 5 |
| 126 | 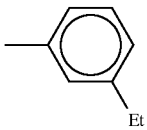  | H | H | 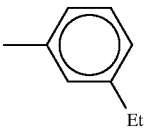  | 4 |

TABLE 2-2-continued

| Phenol Comp. No. | $R^1$, $R^{11}$ | $R^2$, $R^{12}$ | $R^3$, $R^{13}$ | $R^4$, $R^{14}$ | X |
|---|---|---|---|---|---|
| 127 | H | 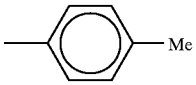 | 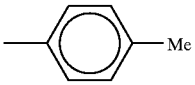 | H | 0 |
| 128 | H | 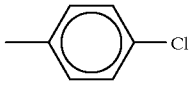 | 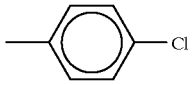 | H | 1 |
| 129 | 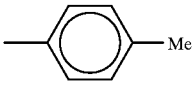 | H | H | 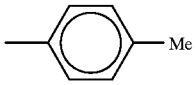 | 2 |
| 130 | 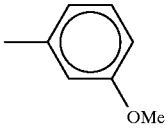 | H | H | 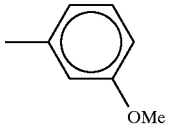 | 3 |

The electrophotographic photoconductor according to the present invention comprises an electroconductive support and a photoconductive layer formed thereon, comprising at least one phenol compound of formula (1), preferably the above-mentioned phenol compound of formula (2) or (3). The reactive gases such as ozone and $No_x$ penetrating into the inside of the photoconductive layer are inactivated by the phenol compound of formula (1) contained in the photoconductive layer. Thus, there can be obtained an electrophotographic photoconductor provided with excellent resistance to the reactive gases. As a result, the charging potential can be prevented from decreasing and the residual potential can be prevented from increasing even though the photoconductor is repeatedly subjected to electrophotographic process.

The photoconductive layer of the electrophotographic photoconductor according to the present invention may be a single-layered or laminated photoconductive layer.

To be more specific, in order to prepare a single-layered photoconductive layer, a charge generation material, a charge transport material and the phenol compound of formula (1) may be contained in the single-layered photoconductive layer.

In the case of the laminated photoconductive layer, the photoconductive layer comprises a charge generation layer comprising a charge generation material and a charge transport material comprising a charge transport material. The charge generation layer and the charge transport layer may be overlaid on the electroconductive support in any order. When the charge transport layer is overlaid on the charge generation layer, it is preferable that the phenol compound of formula (1) be contained in the charge transport layer. When the charge generation layer is provided on the charge transport layer, the phenol compound (1) may be contained in either the charge generation layer or the charge transport layer.

When the phenol compound of formula (1) is contained in the single-layered photoconductive layer, it is preferable that the amount of the phenol compound of formula (1) be in the range of 0.1 to 50 wt. %, more preferably in the range of 0.1 to 30 wt. %, of the total weight of the photoconductive material. When the phenol compound of formula (1) is contained in the charge transport layer (or charge generation layer) for use in the laminated photoconductive layer, it is preferable that the amount of the phenol compound of formula (1) be in the range of 0.1 to 50 wt. %, more preferably in the range of 0.1 to 30 wt. %, of the total weight of the charge transport material (or charge generation material). When the amount of the phenol compound represented by formula (1) is within the above-mentioned range, the resistance to reactive gases can be sufficiently improved without lowering the film quality, the mechanical durability and the sensitivity of the photoconductive layer.

The charge transport material for use in the present invention may comprise a positive-hole transport material or an electron-transport material.

There can be employed any conventional positive-hole transport materials, for example, donor compounds such as a compound having a triphenylamine moiety in the molecule thereof, a hydrazone compound, a pyrazoline compound, a triphenylmethane compound, an oxazole compound, an oxadiazole compound, a compound having carbazole ring therein, a styryl compound, a butadiene compound, a polysilane compound, a poly-N-vinylcarbazole, and a condensation product of pyrene and formalin. Those may be used alone or in combination.

Of the above-mentioned positive-hole transport materials, a stilbene compound represented by the following formula (4) is preferably employed because of its good compatibility with a binder resin:

(4)

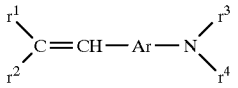

wherein $r^1$ and $r^2$ are each a hydrogen atom, an alkyl group which may have a substituent, an alkoxyl group which may have a substituent or an aryl group which may have a substituent, and $r^1$ and $r^2$ may form a ring in combination; $r^3$ and $r^4$ are each a hydrogen atom, an alkyl group which may have a substituent, an alkoxyl group which may have a substituent, an aryl group which may have a substituent or a heterocyclic group which may have a substituent; and Ar is an arylene group which may have a substituent.

In the above-mentioned formula (4), specific examples of the alkyl group represented by $r^1$, $r^2$, $r^3$ and $r^4$ are methyl group and ethyl group; specific examples of the alkoxyl group represented by $r^1$, $r^2$, $r^3$ and $r^4$ are methoxy group and ethoxy group; and specific examples of the aryl group represented by $r^1$, $r^2$, $r^3$ and $r^4$ are phenyl group and naphthyl group. In addition, the above-mentioned alkyl group, alkoxyl group and aryl group may have a halogen atom such as fluorine atom or chlorine atom as the substituent.

Specific examples of the stilbene compound represented by formula (4) are shown in Table 3.

TABLE 3
(4)
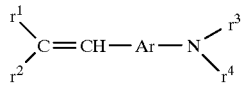
| No. | $r^1$ | $r^2$ | Ar | $r^3$ | $r^4$ |
|---|---|---|---|---|---|
| 1 | $CH_3$ | $CH_3$ | 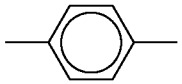 | 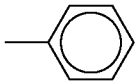 | 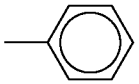 |
| 2 | H | 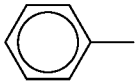 | " | " | " |
| 3 | " | 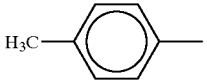  | " | " | " |
| 4 | " | " | " | 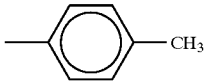  | " |
| 5 | " | " | " | 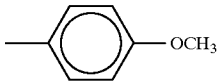  | " |
| 6 | " | " | " | 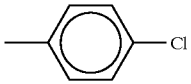  | " |

TABLE 3-continued
(4)
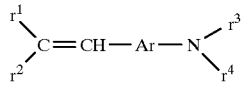
| No. | r1 | r2 | Ar | r3 | r4 |
|---|---|---|---|---|---|
| 7 | " | " | " | 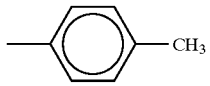 " | 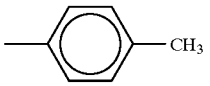 " |
| 8 | " | " | " | 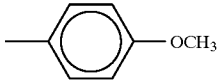 " | 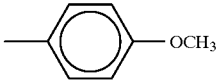 " |
| 9 | $CH_3$ | 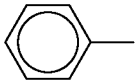 | " | 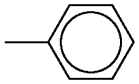 " | 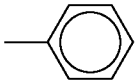 " |
| 10 | H | " | 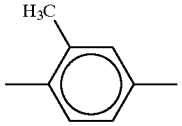 " | " | " |
| 11 | 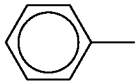 | " | 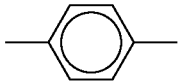 " | $-CH_3$ | " |
| 12 | 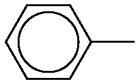 | 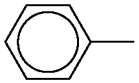 | 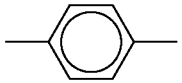 | 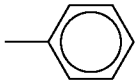 | 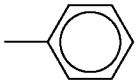 |

TABLE 3-continued
(4)
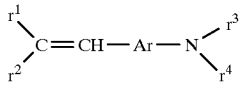
| No. | $r^1$ | $r^2$ | Ar | $r^3$ | $r^4$ |
|---|---|---|---|---|---|
| 13 | " | " | " | 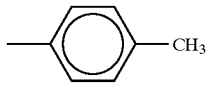 " | " |
| 14 | " | " | " | 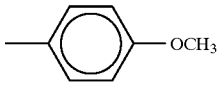 " | " |
| 15 | " | " | " | 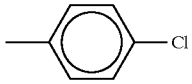 " | " |
| 16 | " | " | " | 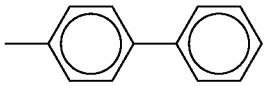 " | " |
| 17 | " | " | " | 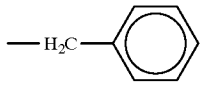 " | " |
| 18 | " | " | " | 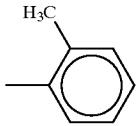 " | " |

TABLE 3-continued
(4)
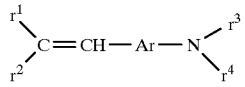
| No. | $r^1$ | $r^2$ | Ar | $r^3$ | $r^4$ |
|---|---|---|---|---|---|
| 19 | " | " | " | 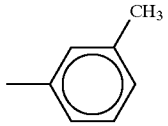 " | " |
| 20 | " | " | " | 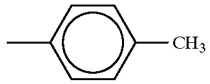 " | 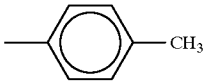 " |
| 21 | " | " | " | 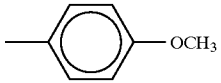 " | 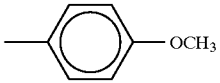 " |
| 22 | " | " | " | 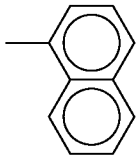 " | 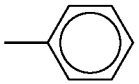 " |
| 23 | 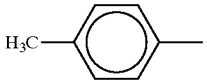 | " | " | 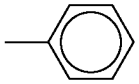 " | " |

TABLE 3-continued
(4)
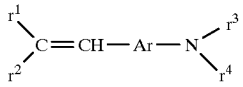
| No. | $r^1$ | $r^2$ | Ar | $r^3$ | $r^4$ |
|---|---|---|---|---|---|
| 24 | 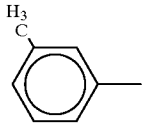 | 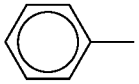 | 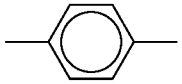 | 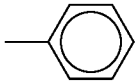 | 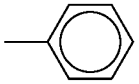 |
| 25 | 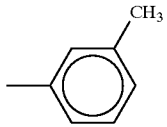 | " | " | " | " |
| 26 | 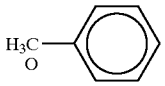 | " | " | " | " |
| 27 | 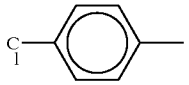 | " | " | " | " |
| 28 | " | " | " | 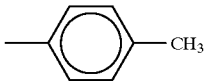 " | " |
| 29 | " | " | " | 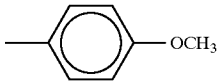 " | " |

TABLE 3-continued
(4)
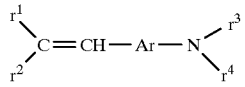
| No. | $r^1$ | $r^2$ | Ar | $r^3$ | $r^4$ |
|---|---|---|---|---|---|
| 30 | 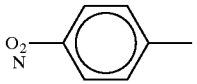 | " | " | 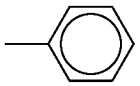 " | " |
| 31 | 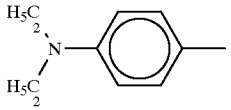 | " | " | " | " |
| 32 | 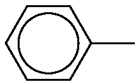 | " | 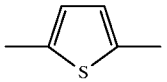 " | " | " |
| 33 | " | " | 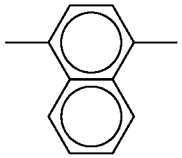 " | " | " |
| 34 | " | H | 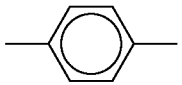 " | 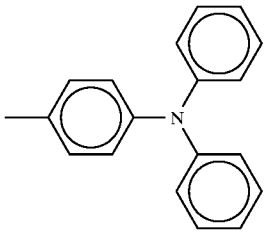 " | " |

TABLE 3-continued
(4)
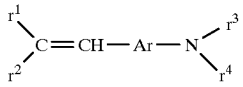
| No. | $r^1$ | $r^2$ | Ar | $r^3$ | $r^4$ |
|---|---|---|---|---|---|
| 35 | 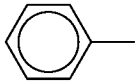 | 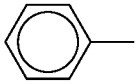 | 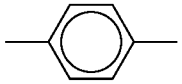 | 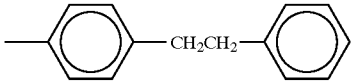  | 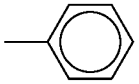 |
| 36 | 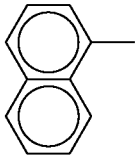 | H | " | 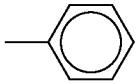 " | " |
| 37 | 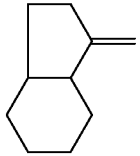 | | " | " | " |
| 38 | 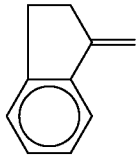 | | " | " | " |

TABLE 3-continued
(4)
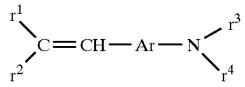
| No. | $r^1$ | $r^2$ | Ar | $r^3$ | $r^4$ |
|---|---|---|---|---|---|
| 39 | 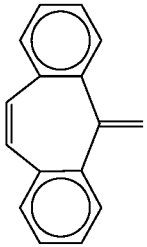 | | " | " | " |
| 40 | 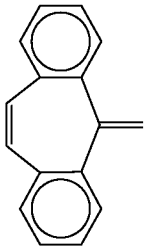 | | " | 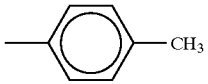  " | 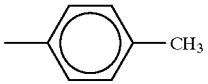  " |
| 41 | 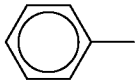 | 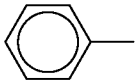 | 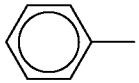 | $-C_2H_5$ | $-C_2H_5$ |

Of the above-mentioned stilbene compounds of formula (4), a triphenylamine compound represented by the following formula (4') is further preferably used as the positive-hole transport material:

(4')

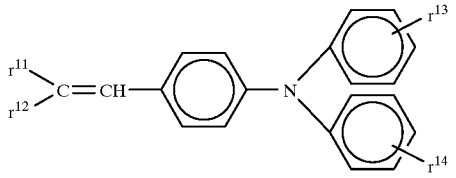

wherein $r^{11}$ and $r^{12}$ each are a hydrogen atom, an alkyl group which may have a substituent, an alkoxyl group which may have a substituent or an aryl group which may have a substituent; and $r^{13}$ and $r^{14}$ each are a hydrogen atom, an alkyl group which may have a substituent or an alkoxyl group which may have a substituent.

The above-mentioned triphenylamine compound of formula (4') is superior in terms of the positive hole transporting performance.

Examples of the electron-transport material for use in the present invention include fluorene compounds such as trinitrofluorenone and fluorenylidene methane derivatives; and quinone compounds such as diphenoquinone and anthraquinone derivatives.

In particular, (2,3-diphenyl-1-indenylidene)-malononitrile represented by the following formula (5) is preferably employed as the electron-transport material:

(5)

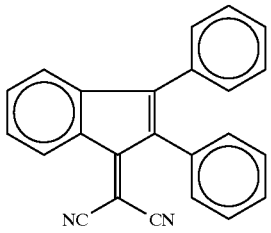

In the electrophotographic photoconductor according to the present invention, any inorganic and organic materials that can absorb the visible light to generate the free charge are usable as the charge generation materials for use in the photoconductive layer.

Specific examples of the inorganic charge generation material are amorphous selenium, trigonal system selenium, selenium—arsenic alloy, selenium—tellurium alloy, cadmium sulfide, cadmium selenide, cadmium sulfoselenide, and amorphous silicon.

Specific examples of the organic charge generation material are bisazo dye, polyazo dye, triarylmethane dye, thiazine dye, oxazine dye, xanthene dye, cyanine dye, styryl dye, pyrylium dye, quinacridone dye, indigo dye, perylene dye, polycyclic quinone dye, bisbenzimidazole dye, indanthrone dye, squarylium dye, anthraquinone dye and phthalocyanine dye.

In particular, X-type metal-free phthalocyanine compound is preferably used as the charge generation material because of its good photosensitivity. Further, oxytitanyl phthalocyanine compound is more preferably employed in the present invention.

When the photoconductive layer comprises the above-mentioned oxytitanyl phthalocyanine pigment as a charge generation material and the phenol compound of formula (1), not only the photoconductive layer can show excellent photosensitivity with respect to the semiconductor laser beam, but also the charging potential is stable even though the electrophotographic process is repeated.

Namely, when the laminated photoconductive layer is employed, it is preferable that the charge generation layer comprise the oxytitanyl phthalocyanine pigment and that the charge transport layer comprise a charge transport material and the phenol compound of formula (1). In this case, a photoconductor with high sensitivity with respect to the semiconductor laser can be obtained due to the use of the oxytitanyl phthalocyanine pigment as the charge generation material, and in addition, the deterioration of sensitivity, the decrease of charging characteristics and the increase of residual potential can be effectively prevented because of the phenol compound contained in the charge transport layer. When the single-layered photoconductive layer is employed, the single-layered photoconductive layer may comprise the oxytitanyl phthalocyanine pigment as the charge generation material, the charge transport material and the phenol compound of formula (1). The same effects as obtained in the laminated photoconductive layer can be gained by the above-mentioned combination.

The basic structure of the previously mentioned oxytitanyl phthalocyanine pigment is represented by the following formula (6):

(6)

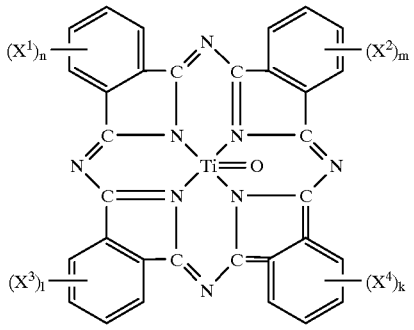

wherein $X^1$, $X^2$, $X^3$ and $X^4$ are each independently a halogen atom; and n, m, l and k are each independently an integer of 0 to 4.

The oxytitanyl phthalocyanine pigment preferably used in the present invention can be obtained by aggregating the units with the above-mentioned basic structure represented by formula (6), for example, in accordance with the methods as disclosed in Japanese Laid-Open Patent Applications 62-275272, 64-17066, 2-28265, 3-35064, 3-200790 and 3-269064. There are disclosed the oxytitanyl phthalocyanine pigments in various crystalline forms, and any can be used in the present invention.

The electrophotographic photoconductor according to the present invention can be easily fabricated. For the fabrication of the laminated photoconductive layer, a coating liquid for a charge generation layer is prepared by dispersing a charge generation material in an appropriate solvent, with a binder resin being optionally added thereto, using a ball mill, ultrasonic wave, or a homomixer. Then, the above prepared dispersion may be coated on an electroconductive support by dip coating, blade coating or spray coating, and dried, so that the charge generation layer is provided on the electroconductive layer.

To upgrade the dispersibility of the charge generation material in the charge generation layer, it is preferable that the average particle size of the charge generation material for use in the present invention be in the range of 0.01 to 2 μm, and more preferably 0.01 to 1 μm. When the average particle size of the charge generation material is within the above-mentioned range, aggregation of fine particles can be prevented, so that the increase of the resistivity of the charge generation layer can be prevented. In addition, the deterioration of sensitivity and durability in the repeated use caused by the increase of defective crystallites can be prevented.

It is preferable that the amount ratio by weight of the charge generation material to the binder resin in the charge generation layer be in the range of (100:0) to (100:500), more preferably in the range of (100:0) to (100:300).

The thickness of the charge generation layer is preferably in the range of 0.05 to 10 μm, and more preferably in the range of 0.1 to 5 μm.

After the formation of the charge generation layer on the support, a coating liquid for the charge transport layer may be prepared in such a manner that a charge transport material and the phenol compound of formula (1) are dissolved or dispersed in an appropriate solvent, optionally in combination with a binder resin, and the thus prepared coating liquid is coated on the charge generation layer and dried. Thus, the charge transport layer is provided on the charge generation layer, thereby obtaining a laminated photoconductive layer. The overlaying order of the charge generation layer and the charge transport layer may be reversed.

It is preferable that the amount ratio by weight of the charge transport material to the binder resin in the charge transport layer be in the range of (100:0) to (100:400), more preferably in the range of (100:50) to (100:200).

The thickness of the charge transport layer is preferably in the range of 5 to 50 μm, and more preferably in the range of 10 to 30 μm.

In the case where the photoconductor comprising a single-layered photoconductive layer is fabricated, a charge transport material, a charge generation material and the phenol compound of formula (1) may be dissolved or dispersed in an appropriate solvent, with a binder resin being optionally added thereto when necessary, thereby preparing a coating liquid for the photoconductive layer. The thus obtained photoconductive layer coating liquid may be coated on the electroconductive support and dried.

Examples of the binder resin for use in the charge generation layer, the charge transport layer, or the single-layered photoconductive layer include addition polymerization-type resins, polyaddition-type resins and polycondensation-type resins such as polyethylene, polyvinyl butyral, polyvinyl formal, polystyrene resin, polypropylene, acrylic resin, methacrylic resin, vinyl chloride resin, vinyl acetate resin, epoxy resin, polyurethane resin, phenolic resin, polyester resin, alkyd resin, polycarbonate resin, polyamide resin, silicone resin and melamine resin; copolymer resins comprising as the repeat units two or more monomers for use in the above-mentioned resins, for example, insulating resins such as vinyl chloride—vinyl acetate copolymer resin, styrene—acrylic copolymer resin and vinyl chloride—vinyl acetate—maleic anhydride copolymer resin; and polymeric organic semiconductor such as poly-N-vinylcarbazole.

Specific examples of the solvent which is used to prepare a dispersion or solution for the charge generation layer coating liquid, the charge transport layer coating liquid or the single-layered photoconductive layer coating liquid include N,N-dimethylformamide, toluene, xylene, monochlorobenzene, 1,2-dichloroethane, 1,1,1-trichloroethane, dichloromethane, 1,1,2-trichloroethane, trichloroethylene, tetrahydrofuran, methyl ethyl ketone, methyl isobutyl ketone, cyclohexanone, ethyl acetate and butyl acetate.

For the electroconductive support, there can be employed a metallic plate, drum or foil made of aluminum, nickel, copper, titanium, gold or stainless steel; a plastic film on which an electroconductive material such as aluminum, nickel, copper, titanium, gold, tin oxide or indium oxide is deposited; and a sheet of paper or a plastic film, which may be formed in a drum, coated with an electroconductive material.

The electrophotographic photoconductor of the present invention may further comprise an intermediate layer which is provided between the electroconductive support and the photoconductive layer in order to prevent the charge injection from the electroconductive support to the photoconductive layer in the course of charging step, and improve the adhesion between the support and the photoconductive layer.

The above-mentioned intermediate layer may be a resin layer which comprises, for instance, polyamide resin, polyvinyl alcohol, ethyl cellulose, carboxymethyl cellulose, vinyl chloride- vinyl acetate copolymer, vinyl chloride—vinyl acetate- maleic anhydride copolymer, casein, and N-alkoxymethyl nylon. Further, tin oxide, aluminum oxide, titanium oxide, silicon oxide or indium oxide may be dispersed in the above-mentioned resin layer. Alternatively, aluminum oxide, zinc oxide, titanium oxide or silicon oxide may be deposited on the electroconductive support to provide the intermediate layer on the support.

Furthermore, a protective layer may be provided on the photoconductive layer to improve the wear resistance and the mechanical durability of the photoconductor.

The above-mentioned protective layer may be a resin layer comprising the same resin as employed in the preparation of the intermediate layer, or a low-resistivity material such as tin oxide or indium oxide may be dispersed in the above-mentioned resin layer. Alternatively, an organic plasma polymerized film can be used as the protective layer, and in this case, oxygen atom, a halogen atom, or an atom belonging to the group III or V in the periodic table may be added to the plasma polymerized film.

Other features of this invention will become apparent in the course of the following description of exemplary embodiments, which are given for illustration of the invention and are not intended to be limiting thereof.

SYNTHESIS EXAMPLE 1

[Synthesis of Phenol Compound No. 1]

A mixture of 60 mmol of 2,6-di-tert-butylphenol and 30 mmol of benzaldehyde was stirred at room temperature in a conical flask. 60 drops of sulfuric acid were added to the above-mentioned mixture over a period of 2 hours, and the reaction mixture thus obtained was further stirred at room temperature for 3 hours.

Thereafter, the reaction mixture was poured into ice water in a beaker, with chloroform being put therein at the same time. The mixture was neutralized by use of sodium hydrogen carbonate, and transferred into a separatory funnel, so that an organic layer was separated from a water layer. The thus obtained organic layer was thoroughly washed with water two times, and dried by use of magnesium sulfate. The solvent component was distilled away, and a crude product was isolated by column chromatography. The thus obtained crude product was recrystallized from methanol, so that a desired phenol compound (No. 1 shown in Table 1) was obtained.

The melting point and the results of the elemental analysis of the above obtained phenol compound No. 1 are shown in Table 5.

SYNTHESIS EXAMPLES 2 to 13

The procedure for synthesis of the phenol compound No. 1 in Synthesis Example 1 was repeated except that the benzaldehyde used in Synthesis Example 1 was replaced by the respective substituted aldehyde compounds as shown in Table 4.

Thus, phenol compounds as shown in Table 5 were obtained.

The melting point and the results of the elemental analysis of each of the above obtained phenol compounds are shown in Table 5.

TABLE 4

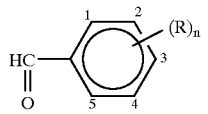

| | Substituent: $(R)_n$ |
|---|---|
| Synthesis Example 1 | H |
| Synthesis Example 2 | 1-$CH_3$ |
| Synthesis Example 3 | 2-$CH_3$ |
| Synthesis Example 4 | 3-CN |
| Synthesis Example 5 | 3-$CF_3$ |
| Synthesis Example 6 | 2-$CF_3$ |
| Synthesis Example 7 | 1-$CF_3$ |
| Synthesis Example 8 | 3-$NO_2$ |
| Synthesis Example 9 | 3-$COOCH_3$ |
| Synthesis Example 10 | 3-$C_6H_5$ |
| Synthesis Example 11 | 3-OH, 2-tert-Bu, 4-tert-Bu |
| Synthesis Example 12 | 2-$OCH_3$ |
| Synthesis Example 13 | 1-$OCH_3$ |

TABLE 5

| Synthesis Example | Phenol Compound No. | Melting Point (° C.) | Calculated C (%) | Calculated H (%) | Calculated N (%) | Found C (%) | Found H (%) | Found N (%) |
|---|---|---|---|---|---|---|---|---|
| 1 | 1 | 153.0–153.5 | 83.66 | 9.99 | 0 | 83.95 | 9.66 | 0 |
| 2 | 2 | 145.0–145.5 | 84 | 10.09 | 0 | 83.99 | 9.8 | 0 |
| 3 | 3 | 81.5–82.5 | 83.89 | 10.01 | 0 | 83.99 | 9.8 | 0 |
| 4 | 7 | 218.0–218.5 | 82.1 | 9.27 | 2.63 | 82.31 | 9.01 | 2.64 |
| 5 | 8 | 122.5–123.5 | 76.2 | 8.4 | 0 | 76.02 | 8.33 | 0 |
| 6 | 9 | 128.0–128.5 | 76.2 | 8.2 | 0 | 76.02 | 8.33 | 0 |
| 7 | 10 | 162.5–163.5 | 76.2 | 8.57 | 0 | 76.02 | 8.33 | 0 |
| 8 | 11 | 162.5–163.0 | 77.14 | 8.96 | 2.61 | 77.03 | 8.68 | 2.57 |
| 9 | 12 | 194.0–195.5 | 79.75 | 9.23 | 0 | 79.53 | 9.02 | 0 |
| 10 | 14 | 180.0–180.5 | 85.33 | 8.91 | 0 | 85.37 | 9.09 | 0 |

TABLE 5-continued

| Synthesis Example | Phenol Compound No. | Melting Point (° C.) | Calculated C (%) | Calculated H (%) | Calculated N (%) | Found C (%) | Found H (%) | Found N (%) |
|---|---|---|---|---|---|---|---|---|
| 11 | 18 | 125.5–126.5 | 81.99 | 10.21 | 0 | 82.ii | 10.25 | 0 |
| 12 | 27 | 126.5–127.0 | 81.51 | 9.46 | 0 | 81.46 | 9.5 | o |
| 13 | 28 | 161.5–162.0 | 81.48 | 9.88 | 0 | 81.46 | 9.5 | o |

SYNTHESIS EXAMPLE 14

[Synthesis of Phenol Compound No. 105]

40 mmol of 2,6-di-phenylphenol and 160 mmol of potassium permanganate were put into 300 ml of chloroform, and heated under reflux for 3 hours.

An insoluble matter was separated by filtration. The resulting filtrate was dried up, and a crude product was isolated by column chromatography on silica gel. The thus obtained crude product was recrystallized from cyclohexane, so that a diphenoquinone compound (B-1) was obtained as an intermediate in a yield of 96%.

The melting point of this diphenoquinone compound was 278° C.

(B-1)

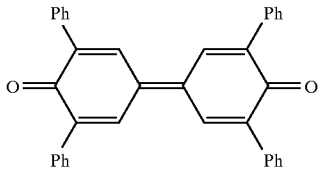

wherein Ph represents a phenyl group.

Thereafter, 6 mmol of the above obtained diphenoquinone compound (B-1) was dissolved in 300 ml of ethylene glycol dimethyl ether. An aqueous solution prepared by dissolving 300 mmol of hydrosulfite and 84mmol of sodium hydroxide in 300 ml of water was added to the above prepared solution of diphenoquinone compound (B-1). The obtained reaction mixture was stirred at room temperature for 3 hours.

After the reaction mixture was extracted with chloroform, the resultant chloroform layer was washed with water and subjected to column chromatography on silica gel, so that a crude product was obtained. The thus obtained crude product was recrystallized from toluene, so that a phenol compound No. 105 (as shown in Table 2) was obtained in a yield of 85%.

The melting point and the results of the elemental analysis of the above obtained phenol compound No. 105 are shown in Table 6.

SYNTHESIS EXAMPLES 15 to 19

The procedure for synthesis of the phenol compound No. 105 in Synthesis Example 14 was repeated except that the starting material employed in Synthesis Example 14 was replaced by the respective materials.

Thus, phenol compounds as shown in Table 6 were obtained.

The melting point and the results of the elemental analysis of each of the above obtained phenol compounds are shown in Table 6.

TABLE 6

| Synthesis Example | Phenol Compound No. | Melting Point (° C.) | Calculated C (%) | Calculated H (%) | Calculated N (%) | Found C (%) | Found H (%) | Found N (%) |
|---|---|---|---|---|---|---|---|---|
| 14 | 105 | 183.0–184.0 | 88.15 | 5.36 | 0 | 88.13 | 5.36 | 0 |
| 15 | 101 | 216.0–218.0 | 79.12 | 7.60 | 0 | 79.31 | 7.49 | 0 |
| 16 | 102 | 175.5–176.5 | 81.67 | 10.58 | 0 | 81.89 | 10.31 | 0 |
| 17 | 103 | 172.0–172.5 | 81.03 | 9.53 | 0 | 80.93 | 9.26 | 0 |
| 18 | 104 | 107.5–108.0 | 81.43 | 9.87 | 0 | 81.31 | 9.67 | 0 |
| 19 | 107 | 229–230 | 82.51 | 10.15 | 0 | 82.38 | 10.48 | 0 |

EXAMPLE 1

[Fabrication of photoconductor No. 1 comprising a laminated photoconductive layer]

(Formation of charge generation layer)

A mixture of 5 parts by weight of a trisazo pigment represented by the following formula (P-1), serving as a charge generation material, 5 parts by weight of a commercially available polyvinyl butyral resin (Trademark "S-Lec BLS", made by Sekisui Chemical Co., Ltd.) and 90 parts by weight of tetrahydrofuran was dispersed in a ball mill for 12 hours. Then, tetrahydrofuran was further added to the above prepared dispersion so that the concentration of the dispersion might reach 2 wt. %. Thus, a coating liquid for a charge generation layer was prepared.

(P-1)

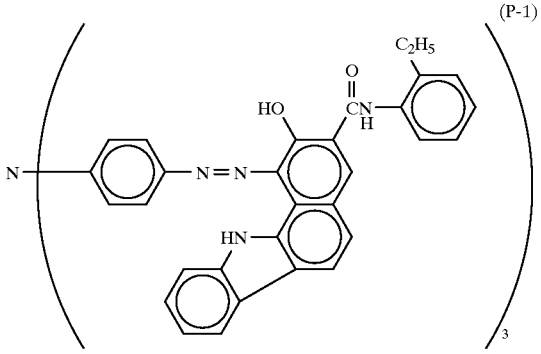

The thus prepared charge generation layer coating liquid was coated on an aluminum plate serving as an electroconductive support using a doctor blade by cast coating method, and dried. Thus, a charge generation layer with a thickness of 0.5 μm was provided on the electroconductive support.

(Formation of charge transport layer)

A mixture of 202.5 g of tetrahydrofuran, 25.0 g of Z type polycarbonate (made by Teijin Chemicals Ltd.) and 5.0 g of 0.1 wt. % tetrahydrofuran solution of a commercially available silicone oil (Trademark "KF50", made by Shin-Etsu Chemical Co., Ltd.) was stirred at room temperature, so that a Z type polycarbonate solution was prepared.

9.3 g of the above-mentioned Z type polycarbonate solution was added to a mixture of 0.7 g of a positive-hole transport material represented by the following formula (D-1) and 50 mg of the phenol compound No. 2 (shown in Table 1). The obtained mixture was stirred at room temperature to prepare a coating liquid for a charge transport layer.

(D-1)

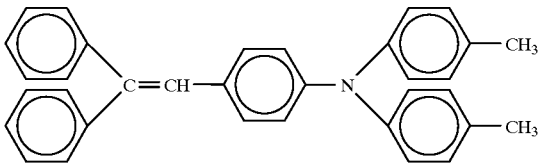

The thus prepared charge transport layer coating liquid was coated on the above prepared charge generation layer using a doctor blade and dried, so that a charge transport layer with a thickness of 20 μm was provided on the charge generation layer.

Thus, an electrophotographic photoconductor No. 1 according to the present invention was fabricated.

EXAMPLE 2

The procedure for fabrication of the electrophotographic photoconductor No. 1 in Example 1 was repeated except that the phenol compound No. 2 for use in the charge transport layer coating liquid in Example 1 was replaced by the phenol compound No. 9 (shown in Table 1).

Thus, an electrophotographic photoconductor No. 2 according to the present invention was fabricated.

EXAMPLE 3

The procedure for fabrication of the electrophotographic photoconductor No. 1 in Example 1 was repeated except that the phenol compound No. 2 for use in the charge transport layer coating liquid in Example 1 was replaced by the phenol compound No. 10 (shown in Table 1).

Thus, an electrophotographic photoconductor No. 3 according to the present invention was fabricated.

EXAMPLE 4

The procedure for fabrication of the electrophotographic photoconductor No. 1 in Example 1 was repeated except that the phenol compound No. 2 for use in the charge transport layer coating liquid in Example 1 was replaced by the phenol compound No. 14 (shown in Table 1).

Thus, an electrophotographic photoconductor No. 4 according to the present invention was fabricated.

COMPARATIVE EXAMPLE 1

The procedure for fabrication of the electrophotographic photoconductor No. 1 in Example 1 was repeated except that the phenol compound No. 2 was removed from the formulation for the charge transport layer coating liquid employed in Example 1.

Thus, a comparative electrophotographic photoconductor No. 1 was fabricated.

Each of the electrophotographic photoconductors No. 1 to No. 4 according to the present invention and the comparative electrophotographic photoconductor No. 1 was charged negatively in the dark under application of −18 μA of corona charge for 20 seconds using a commercially available electrostatic copying sheet testing apparatus "Paper Analyzer Model EPA-8100" (Trademark), made by Kawaguchi Electro Works Co., Ltd.

Then, each photoconductor was allowed to stand in the dark for 20 seconds without applying any charge thereto, and the surface potential Vo (−V) of the photoconductor was measured.

Each photoconductor was then illuminated by a monochromatic light of 780 nm in such a manner that the illuminance of the illuminated surface of the photoconductor was 5 $\mu W/cm^2$, and the exposure $E_{1/2}$ ($\mu J/cm^2$) required to reduce the initial surface potential Vo (−V) to ½ the initial surface potential Vo (−V) was measured.

In addition, after each photoconductor was illuminated by the above-mentioned monochromatic light of 780 nm for 30 seconds, the surface potential Vr (−V) of the photoconductor was measured.

Furthermore, after fabrication of the above-mentioned electrophotographic photoconductors, each photoconductor was exposed to $NO_x$ gas ($NO:NO_2$=4:1) in a concentration of 50 ppm at room temperature for 4 days in an exposure test apparatus.

After the exposure to $NO_x$ for 4 days, the initial surface potential Vo (−V), the exposure $E_{1/2}$ ($\mu J/cm^2$), and the residual potential Vr (−V) were measured in the same manner as mentioned above.

The results are shown in Table 7.

TABLE 7

| | Before Exposure to $NO_x$ | | | After Exposure to $NO_x$ | | |
|---|---|---|---|---|---|---|
| | $V_o$ (−V) | $E_{1/2}$ ($\mu$J/cm$^2$) | $V_r$ (−V) | $V_o$ (−V) | $E_{1/2}$ ($\mu$J/cm$^2$) | $V_r$ (−V) |
| Ex. 1 | 1020 | 0.44 | 0 | 720 | 0.33 | 0 |
| Ex. 2 | 1030 | 0.49 | 0 | 850 | 0.40 | 0 |
| Ex. 3 | 990 | 0.47 | 0 | 840 | 0.38 | 0 |
| Ex. 4 | 1030 | 0.46 | 0 | 860 | 0.37 | 0 |
| Comp. Ex. 1 | 1010 | 0.41 | 0 | 320 | 0.31 | 0 |

As can be seen from the results shown in Table 7, the resistance to reactive gases is excellent, so that the decrease of the charging potential, the deterioration of photosensitivity and the increase of the residual potential are effectively prevented in the electrophotographic photoconductors according to the present invention.

EXAMPLE 5

[Fabrication of photoconductor No. 5 comprising a laminated photoconductive layer]

(Formation of charge generation layer)

A mixture of 5 parts by weight of an X-type metal-free phthalocyanine pigment serving as a charge generation material, 5 parts by weight of a commercially available polyvinyl butyral resin (Trademark "S-Lec BLS", made by Sekisui Chemical Co., Ltd.) and 90 parts by weight of tetrahydrofuran was dispersed in a ball mill for 12 hours. Then, tetrahydrofuran was further added to the above prepared dispersion so that the concentration of the dispersion might reach 2 wt. %. Thus, a coating liquid for a charge generation layer was prepared.

The thus prepared charge generation layer coating liquid was coated on an aluminum plate serving as an electroconductive support using a doctor blade by cast coating method, and dried. Thus, a charge generation layer with a thickness of 0.5 $\mu$m was provided on the electroconductive support.

(Formation of charge transport layer)

A mixture of 8 parts by weight of an electron-transport material represented by the following formula (A-1), one part by weight of the phenol compound No. 2 (shown in Table 1), 12 parts by weight of Z type polycarbonate (made by Teijin Chemicals Ltd.), and 0.02 parts by weight of a commercially available silicone oil (Trademark "KF50", made by Shin-Etsu Chemical Co., Ltd.) was dissolved in 90 parts by weight of tetrahydrofuran, so that a coating liquid for a charge transport layer was prepared.

(A-1)

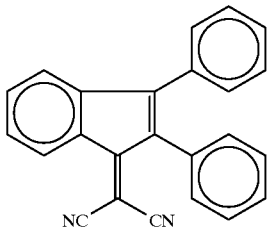

The thus prepared charge transport layer coating liquid was coated on the above prepared charge generation layer using a doctor blade and dried, so that a charge transport layer with a thickness of 20 $\mu$m was provided on the charge generation layer.

Thus, an electrophotographic photoconductor No. 5 according to the present invention was fabricated.

EXAMPLE 6

The procedure for fabrication of the electrophotographic photoconductor No. 5 in Example 5 was repeated except that the phenol compound No. 2 for use in the charge transport layer coating liquid in Example 5 was replaced by the phenol compound No. 9 (shown in Table 1).

Thus, an electrophotographic photoconductor No. 6 according to the present invention was fabricated.

COMPARATIVE EXAMPLE 2

The procedure for fabrication of the electrophotographic photoconductor No. 5 in Example 5 was repeated except that the phenol compound No. 2 was removed from the formulation for the charge transport layer coating liquid employed in Example 5.

Thus, a comparative electrophotographic photoconductor No. 2 was fabricated.

Each of the electrophotographic photoconductors No. 5 and No. 6 according to the present invention and the comparative electrophotographic photoconductor No. 2 was charged positively in the dark under application of +5.3 kV of corona charge for 20 seconds using a commercially available electrostatic copying sheet testing apparatus "Paper Analyzer Model EPA-8200" (Trademark), made by Kawaguchi Electro Works Co., Ltd.

Then, each photoconductor was allowed to stand in the dark for 20 seconds without applying any charge thereto, and the surface potential Vo (V) of the photoconductor was measured.

Each photoconductor was then illuminated by a monochromatic light of 780 nm in such a manner that the illuminance of the illuminated surface of the photoconductor was 5 $\mu$W/cm$^2$, and the exposure $E_{1/2}$ ($\mu$J/cm$^2$) required to reduce the initial surface potential Vo (V) to ½ the initial surface potential Vo (V) was measured.

In addition, after each photoconductor was illuminated by the above-mentioned monochromatic light of 780 nm for 30 seconds, the surface potential Vr (V) of the photoconductor was measured.

Furthermore, after fabrication of the above-mentioned electrophotographic photoconductors, each photoconductor was exposed to $NO_x$ gas ($NO:NO_2$=4:1) in a concentration of 50 ppm at room temperature for 5 days in an exposure test apparatus.

After the exposure to $NO_x$ for 5 days, the initial surface potential Vo (V), the exposure $E_{1/2}$ ($\mu$J/cm$^2$), and the residual potential Vr (V) were measured in the same manner as mentioned above.

The results are shown in Table 8.

TABLE 8

| | Before Exposure to $NO_x$ | | | After Exposure to $NO_x$ | | |
|---|---|---|---|---|---|---|
| | $V_o$ (−V) | $E_{1/2}$ ($\mu$J/cm$^2$) | $V_r$ (−V) | $V_o$ (−V) | $E_{1/2}$ ($\mu$J/cm$^2$) | $V_r$ (−V) |
| Ex. 5 | 1015 | 0.03 | 32 | 1023 | 1.07 | 45 |
| Ex. 6 | 1231 | 1.00 | 28 | 1250 | 1.05 | 36 |
| Comp. Ex. 2 | 1184 | 0.98 | 30 | 1217 | 1.37 | 61 |

As can be seen from the results shown in Table 8, the resistance to reactive gases is excellent, so that the decrease of the charging potential, the deterioration of photosensitivity and the increase of the residual potential are effectively prevented in the electrophotographic photoconductors according to the present invention.

EXAMPLE 7

[Fabrication of photoconductor No. 7 comprising a single-layered photoconductive layer]

(Formation of single-layered photoconductive layer)

1 g of an X-type metal-free phthalocyanine pigment, 10 g of 10 wt. % tetrahydrofuran solution of Z type polycarbonate (made by Teijin Chemicals Ltd.), and 9 g of tetrahydrofuran were pulverized and kneaded overnight in a ball mill pot. To the above prepared mixture, 20 g of 20 wt. % tetrahydrofuran solution of Z type polycarbonate (made by Teijin Chemicals Ltd.) was added, and the thus obtained mixture was further dispersed and kneaded overnight, so that a dispersion of charge generation material was prepared.

0.45 g of the same positive-hole transport material represented by the formula (D-1) as employed in Example 1, 31 mg of the phenol compound No. 2 (shown in Table 1) were put in a container. To this mixture, 1.2 g of the previously prepared 10% dispersion of charge generation material, 0.15 g of 1 wt. % tetrahydrofuran solution of a commercially available silicone oil (Trademark "KF50", made by Shin-Etsu Chemical Co., Ltd.), 1.03 g of tetrahydrofuran, and 4.7 g of 15 wt. % tetrahydrofuran solution of Z type polycarbonate (made by Teijin Chemicals Ltd.) were added. The resultant mixture was stirred at room temperature, whereby a coating liquid for a photoconductive layer was prepared.

The thus prepared photoconductive layer coating liquid was coated on an aluminum plate serving as an electroconductive support by a doctor blade and dried, so that a single-layered photoconductive layer with a thickness of 20 $\mu$m was provided on the support.

Thus, an electrophotographic photoconductor No. 7 according to the present invention was fabricated.

EXAMPLE 8

The procedure for fabrication of the electrophotographic photoconductor No. 7 in Example 7 was repeated except that the phenol compound No. 2 for use in the single-layered photoconductive layer coating liquid in Example 7 was replaced by the phenol compound No. 9 (shown in Table 1).

Thus, an electrophotographic photoconductor No. 8 according to the present invention was fabricated.

EXAMPLE 9

The procedure for fabrication of the electrophotographic photoconductor No. 7 in Example 7 was repeated except that the phenol compound No. 2 for use in the single-layered photoconductive layer coating liquid in Example 7 was replaced by the phenol compound No. 10 (shown in Table 1).

Thus, an electrophotographic photoconductor No. 9 according to the present invention was fabricated.

EXAMPLE 10

The procedure for fabrication of the electrophotographic photoconductor No. 7 in Example 7 was repeated except that the phenol compound No. 2 for use in the single-layered photoconductive layer coating liquid in Example 7 was replaced by the phenol compound No. 14 (shown in Table 1).

Thus, an electrophotographic photoconductor No. 10 according to the present invention was fabricated.

COMPARATIVE EXAMPLE 3

The procedure for fabrication of the electrophotographic photoconductor No. 7 in Example 7 was repeated except that the phenol compound No. 2 was removed from the formulation for the single-layered photoconductive layer coating liquid employed in Example 7.

Thus, a comparative electrophotographic photoconductor No. 3 was fabricated.

Each of the electrophotographic photoconductors No. 7 to No. 10 according to the present invention and the comparative electrophotographic photoconductor No. 3 was charged negatively in the dark under application of −18 $\mu$A of corona charge for 20 seconds using a commercially available electrostatic copying sheet testing apparatus "Paper Analyzer Model EPA-8100" (Trademark), made by Kawaguchi Electro Works Co., Ltd.

Then, each photoconductor was allowed to stand in the dark for 20 seconds without applying any charge thereto, and the surface potential Vo (−V) of the photoconductor was measured.

Each photoconductor was then illuminated by a monochromatic light of 780 nm in such a manner that the illuminance of the illuminated surface of the photoconductor was 5 $\mu$W/cm$^2$, and the exposure $E_{1/2}$ ($\mu$J/cm$^2$) required to reduce the initial surface potential Vo (−V) to ½ the initial surface potential Vo (−V) was measured.

In addition, after each photoconductor was illuminated by the above-mentioned monochromatic light of 780 nm for 30 seconds, the surface potential Vr (−V) of the photoconductor was measured.

Furthermore, after fabrication of the above-mentioned electrophotographic photoconductors, each photoconductor was exposed to $NO_x$ gas ($NO:NO_2$=4:1) in a concentration of 50 ppm at room temperature for 2 days in an exposure test apparatus.

After the exposure to $NO_x$ for 2 days, the initial surface potential Vo (−V), the exposure $E_{1/2}$ ($\mu$J/cm$^2$), and the residual potential Vr (−V) were measured in the same manner as mentioned above.

The results are shown in Table 9.

TABLE 9

| | Before Exposure to $NO_x$ | | | After Exposure to $NO_x$ | | |
|---|---|---|---|---|---|---|
| | $V_o$ (−V) | $E_{1/2}$ ($\mu J/cm^2$) | $V_r$ (−V) | $V_o$ (−V) | $E_{1/2}$ ($\mu J/cm^2$) | $V_r$ (−V) |
| Ex. 7 | 876 | 0.80 | 3 | 796 | 1.42 | 2 |
| Ex. 8 | 800 | 0.81 | 2 | 753 | 1.28 | 1 |
| Ex. 9 | 793 | 0.78 | 2 | 721 | 1.30 | 0 |
| Ex. 10 | 851 | 0.80 | 3 | 788 | 1.25 | 1 |
| Comp. Ex. 3 | 840 | 0.78 | 2 | 380 | 1.83 | 1 |

As can be seen from the results shown in Table 9, the resistance to reactive gases is excellent, so that the decrease of the charging potential, the deterioration of photosensitivity and the increase of the residual potential are effectively prevented in the electrophotographic photoconductors according to the present invention.

(REFERENCE EXAMPLE 1)

[Synthesis of oxytitanyl phthalocyanine]

52.5 g (0.41 mol) of phthalodinitrile and 30 ml of 1-chloronaphthalene were mixed and stirred. To this mixture, 19.0 g (0.1 mol) of titanium tetrachloride was added dropwise in a stream of nitrogen. After the completion of addition, the resultant mixture was gradually heated to 200° C. The mixture was stirred for 5 hours with the temperature of the reaction mixture being maintained in the range of 190 to 210° C. in order to carry out the reaction.

After the completion of the reaction, the reaction mixture was cooled to 130° C. and subjected to filtration under the application of heat thereto. The residual particles were washed with 1-chloronaphthalene until the particles assumed a blue color, and further washed with hot water of 80° C. several times, and then dried, whereby 42.2 g of oxytitanyl phthalocyanine pigment was obtained as a crude product in a yield of 73.3%.

4 g of the thus obtained crude product was gradually dissolved in 80 g of 98% sulfuric acid at 5° C. The thus obtained sulfuric acid solution was stirred for about 1 hour with the temperature being maintained at 5° C. or less. Then, the sulfuric acid solution was slowly poured into 800 ml of ice water which was vigorously stirred. The precipitating crystals were obtained by filtration. The crystals were washed with distilled water until no acid remained, and purified using acetone. After the crystals were dried, 3.6 g of amorphous oxytitanyl phthalocyanine pigment was obtained.

(REFERENCE EXAMPLE 2)

[Synthesis of oxytitanyl phthalocyanine pigment)

The crude product of oxytitanyl phthalocyanine was obtained in the same manner as in Reference Example 1.

6 g of the crude oxytitanyl phthalocyanine pigment was gradually dissolved in 120 g of 98% sulfuric acid at 5° C. The thus obtained sulfuric acid solution was stirred for about 1 hour with the temperature being maintained at 5° C. or less. Then, the sulfuric acid solution was slowly poured into 1200 ml of ice water which was vigorously stirred. The precipitating crystals were obtained by filtration. The crystals were washed with distilled water until no acid remained, so that a wet cake of the oxytitanyl phthalocyanine pigment was obtained.

100 ml of 1,2-dichloroethane was added to the above prepared wet cake of the oxytitanyl phthalocyanine, and the mixture was stirred at room temperature for 2 hours. With the addition of 300 ml of methanol, the mixture was further stirred and subjected to filtration. The resultant residue was washed with methanol and dried, so that 4.9 g of crystalline oxytitanyl phthalocyanine pigment was obtained.

FIG. 1 is an X-ray diffraction spectrum of the amorphous oxytitanyl phthalocyanine pigment obtained in Reference Example 1. As shown in FIG. 1, there is no strong peak in the diffraction spectrum.

Figure 2:
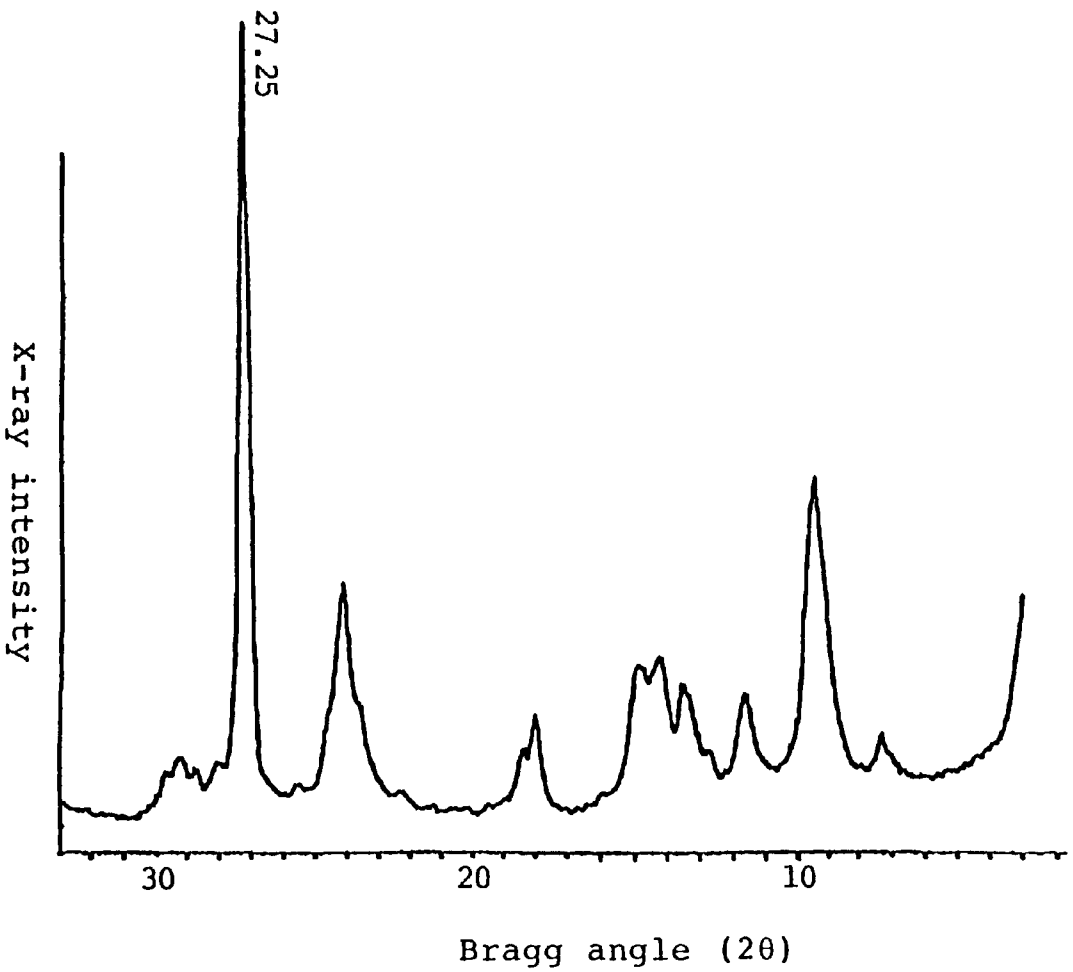
FIG. 2 is an X-ray diffraction spectrum of a crystalline oxytitanyl phthalocyanine pigment obtained in Reference Example 2.

FIG. 2 is an X-ray diffraction spectrum of the crystalline oxytitanyl phthalocyanine pigment obtained in Reference Example 2. In FIG. 2, strong peaks appear at a Bragg angle (2θ) of 9.5 and 27.2 deg.

The above-mentioned X-ray diffraction spectra were obtained under the following measuring conditions:

X-ray tube: Cu
Voltage: 40 kV
Current: 20 mA
Scanning speed: 1 deg/min.
Scanning scope: 3 to 40 deg.

EXAMPLE 11

[Fabrication of photoconductor No. 11 comprising a laminated photoconductive layer]

(Formation of intermediate layer)

Three parts by weight of a commercially available alcohol-soluble polyamide (Trademark "CM-8000", made by Toray Industries, Inc.) were dissolved in 100 parts by weight of a mixed solvent consisting of methanol and n-butanol with a ratio by volume of 8:2 under the application of heat thereto, whereby a coating liquid for an intermediate layer was prepared.

The thus prepared intermediate layer coating liquid was coated on the aluminum-deposited surface of an aluminum deposited PET film with a thickness of 75 μm, serving as an electroconductive support, and dried at 100° C. for 10 minutes. Thus, an intermediate layer with a thickness of 0.1 μm was provided on the support.

(Formation of charge generation layer)

Two parts by weight of the crystalline oxytitanyl phthalocyanine pigment prepared in Reference Example 2 and 2 parts by weight of a commercially available polyvinyl butyral resin (Trademark "BM-S" made by Sekisui Chemical Co., Ltd.) were added to 46 parts by weight of n-butyl acetate, and the obtained mixture was dispersed in a sand mill using 1-mm diameter glass beads for 12 hours. Thereafter, the above-mentioned mixture was diluted with 150 parts by weight of n-butyl acetate, so that a coating liquid for a charge generation layer was prepared.

The thus prepared charge generation layer coating liquid was coated on the intermediate layer and dried at 80° C. for 5 minutes, whereby a charge generation layer with a thickness of 0.2 μm was provided on the intermediate layer.

(Formation of charge transport layer)

The following components were dissolved in 100 parts by weight of tetrahydrofuran, so that a coating liquid for a charge transport layer was prepared:

| | Parts by weight |
|---|---|
| Positive-hole transport material (D-1) | 8 |
| Phenol compound No. 2 (shown in Table 1) | 1 |
| Polycarbonate resin (Trademark "IUPILON Z200" made by Mitsubishi Gas Chemical Company, Inc.) | 10 |
| Silicone oil (Trademark "KF-50" made by Shin-Etsu Chemical Co., Ltd.) | 0.002 |

The thus prepared charge transport layer coating liquid was coated on the charge generation layer, and dried at 110° C. for 10 minutes, so that a charge transport layer with a thickness of 20 μm was provided on the charge generation layer.

Thus, an electrophotographic photoconductor No. 11 according to the present invention was fabricated.

EXAMPLE 12

The procedure for fabrication of the electrophotographic photoconductor No. 11 in Example 11 was repeated except that the phenol compound No. 2 for use in the charge transport layer coating liquid in Example 11 was replaced by the phenol compound No. 3 (shown in Table 1).

Thus, an electrophotographic photoconductor No. 12 according to the present invention was fabricated.

EXAMPLE 13

The procedure for fabrication of the electrophotographic photoconductor No. 11 in Example 11 was repeated except that the phenol compound No. 2 for use in the charge transport layer coating liquid in Example 11 was replaced by the phenol compound No. 12 (shown in Table 1).

Thus, an electrophotographic photoconductor No. 13 according to the present invention was fabricated.

EXAMPLE 14

The procedure for fabrication of the electrophotographic photoconductor No. 11 in Example 11 was repeated except that the phenol compound No. 2 for use in the charge transport layer coating liquid in Example 11 was replaced by the phenol compound No. 14 (shown in Table 1).

Thus, an electrophotographic photoconductor No. 14 according to the present invention was fabricated.

COMPARATIVE EXAMPLE 4

The procedure for fabrication of the electrophotographic photoconductor No. 11 in Example 11 was repeated except that the phenol compound No. 2 was removed from the formulation for the charge transport layer coating liquid employed in Example 11.

Thus, a comparative electrophotographic photoconductor No. 4 was fabricated.

EXAMPLE 15

The procedure for fabrication of the electrophotographic photoconductor No. 11 in Example 11 was repeated except that the positive-hole transport material (D-1) for use in the charge transport layer coating liquid in Example 11 was replaced by a positive-hole transport material represented by the following formula (D-2):

(D-2)

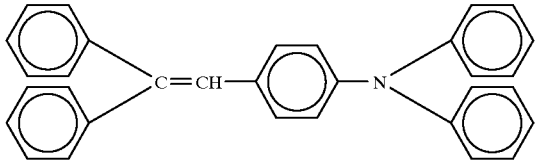

Thus, an electrophotographic photoconductor No. 15 according to the present invention was fabricated.

EXAMPLE 16

The procedure for fabrication of the electrophotographic photoconductor No. 15 in Example 15 was repeated except that the phenol compound No. 2 for use in the charge transport layer coating liquid in Example 15 was replaced by the phenol compound No. 3 (shown in Table 1).

Thus, an electrophotographic photoconductor No. 16 according to the present invention was fabricated.

EXAMPLE 17

The procedure for fabrication of the electrophotographic photoconductor No. 15 in Example 15 was repeated except that the phenol compound No. 2 for use in the charge transport layer coating liquid in Example 15 was replaced by the phenol compound No. 12 (shown in Table 1).

Thus, an electrophotographic photoconductor No. 17 according to the present invention was fabricated.

COMPARATIVE EXAMPLE 5

The procedure for fabrication of the electrophotographic photoconductor No. 15 in Example 15 was repeated except that the phenol compound No. 2 was removed from the formulation for the charge transport layer coating liquid employed in Example 15.

Thus, a comparative electrophotographic photoconductor No. 5 was fabricated.

EXAMPLE 18

The procedure for fabrication of the electrophotographic photoconductor No. 11 in Example 11 was repeated except that the crystalline oxytitanyl phthalocyanine pigment for use in the charge generation layer coating liquid in Example 11 was replaced by the amorphous oxytitanyl phthalocyanine pigment prepared in Reference Example 1.

Thus, an electrophotographic photoconductor No. 18 according to the present invention was fabricated.

COMPARATIVE EXAMPLE 6

The procedure for fabrication of the electrophotographic photoconductor No. 18 in Example 18 was repeated except that the phenol compound No. 2 was removed from the formulation for the charge transport layer coating liquid employed in Example 18.

Thus, a comparative electrophotographic photoconductor No. 6 was fabricated.

The dynamic electrostatic properties of each of the electrophotographic photoconductors No. 11 to No. 18 according to the present invention and the comparative electrophotographic photoconductors No. 4 to No. 6 were evaluated using a commercially available test apparatus "EPA8200" (Trademark), made by Kawaguchi Electro Works Co., Ltd.

To be more specific, each photoconductor was charged negatively in the dark under the application of −6 kV by corona charge for 5 seconds. Then, each photoconductor was allowed to stand in the dark without applying any charge thereto for 2 seconds, and the surface potential $V_2$ (−V) was measured. In addition, when the surface potential of the photoconductor reached −800 V, the photoconductor was illuminated by the light of 780 nm with a light intensity of 5.0 $\mu$W/cm$^2$ separated by use of a band pass filter. In each case, the exposure $E_{1/2}$ ($\mu$J/cm$^2$) required to reduce the surface potential to ½ the surface potential, that is, −400 V, was measured. Further, the surface potential Vr (−V) was measured after the photoconductor was subjected to light exposure for 30 seconds.

Furthermore, after the fabrication of the above-mentioned electrophotographic photoconductors, each photoconductor was charged negatively in the dark under the application of −6 kV by corona charge, and illuminated by a tungsten lamp with a color temperature of 2856K in such a manner that the illuminance of the illuminated surface of the photoconductor was 45 lux. Such charging and light exposure steps were repeated 10,000 times. After such fatigue, the dynamic electrostatic properties were measured in the same manner as mentioned above.

The results are shown in Table 10.

TABLE 10

| | Electrostatic Properties (Initial stage) | | | Electrostatic Properties (After fatigue) | | |
|---|---|---|---|---|---|---|
| | $V_2$ (−V) | $E_{1/2}$ ($\mu$J/cm$^2$) | $V_r$ (−V) | $V_2$ (−V) | $E_{1/2}$ ($\mu$J/cm$^2$) | $V_r$ (−V) |
| Ex. 11 | 850 | 0.13 | 3 | 680 | 0.13 | 10 |
| Ex. 12 | 870 | 0.12 | 1 | 880 | 0.12 | 14 |
| Ex. 13 | 880 | 0.18 | 9 | 900 | 0.18 | 32 |
| Ex. 14 | 910 | 0.17 | 8 | 900 | 0.17 | 30 |
| Comp. Ex. 4 | 952 | 0.17 | 7 | 780 | 0.17 | 47 |
| Ex. 15 | 900 | 0.15 | 23 | 880 | 0.15 | 26 |
| Ex. 16 | 890 | 0.17 | 15 | 900 | 0.17 | 22 |
| Ex. 17 | 914 | 0.16 | 22 | 854 | 0.17 | 35 |
| Comp. Ex. 5 | 944 | 0.18 | 24 | 729 | 0.18 | 61 |
| Ex. 18 | 660 | 0.25 | 22 | 640 | 0.26 | 30 |
| Comp. Ex. 6 | 664 | 0.31 | 32 | 272 | 1.62 | 97 |

EXAMPLE 19

[Fabrication of photoconductor No. 19 comprising a laminated photoconductive layer]

The intermediate layer and the charge generation layer were provided on the same aluminum-deposited PET film in the same manner as in Example 11.

(Formation of charge transport layer)

The following components were dissolved in 100 parts by weight of tetrahydrofuran, so that a coating liquid for a charge transport layer was prepared:

| | Parts by weight |
|---|---|
| Electron transport material (A-1) | 8 |
| Phenol compound No. 2 (shown in Table 1) | 1 |
| Z type polycarbonate (made by Teijin Chemicals Ltd.) | 10 |
| Silicone oil (Trademark "KF-50" made by Shin-Etsu Chemical Co., Ltd.) | 0.02 |

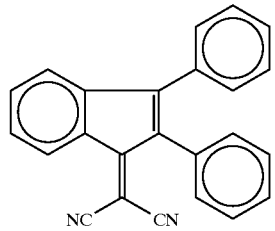

The thus prepared charge transport layer coating liquid was coated on the charge generation layer, and dried at 110° C. for 10 minutes, so that a charge transport layer with a thickness of 20 $\mu$m was provided on the charge generation layer.

Thus, an electrophotographic photoconductor No. 19 according to the present invention was fabricated.

COMPARATIVE EXAMPLE 7

The procedure for fabrication of the electrophotographic photoconductor No. 19 in Example 19 was repeated except that the phenol compound No. 2 was removed from the formulation for the charge transport layer coating liquid employed in Example 19.

Thus, a comparative electrophotographic photoconductor No. 7 was fabricated.

EXAMPLE 20

The procedure for fabrication of the electrophotographic photoconductor No. 19 in Example 19 was repeated except that the crystalline oxytitanyl phthalocyanine pigment for use in the charge generation layer coating liquid in Example 19 was replaced by the amorphous oxytitanyl phthalocyanine pigment prepared in Reference Example 1.

Thus, an electrophotographic photoconductor No. 20 according to the present invention was fabricated.

COMPARATIVE EXAMPLE 8

The procedure for fabrication of the electrophotographic photoconductor No. 20 in Example 20 was repeated except that the phenol compound No. 2 was removed from the formulation for the charge transport layer coating liquid employed in Example 20.

Thus, a comparative electrophotographic photoconductor No. 8 was fabricated.

The dynamic electrostatic properties of each of the electrophotographic photoconductors No. 19 and No. 20 according to the present invention and the comparative electrophotographic photoconductors No. 7 and No. 8 were evaluated using a commercially available test apparatus "EPA8200" (Trademark), made by Kawaguchi Electro Works Co., Ltd.

To be more specific, each photoconductor was charged positively in the dark under the application of +5.3 kV by corona charge for 5 seconds. Then, each photoconductor was allowed to stand in the dark without applying any charge thereto for 2 seconds, and the surface potential $V_2$ (+V) was measured. In addition, when the surface potential of the photoconductor reached +800 V, the photoconductor was illuminated by the light of 780 nm with a light intensity of 5.0 $\mu$W/cm$^2$ separated by use of a band pass filter. In each case, the exposure $E_{1/2}$ ($\mu$J/cm$^2$) required to reduce the surface potential to ½ the surface potential, that is, +400 V, was measured.

Further, the surface potential Vr (+V) was measured after the photoconductor was subjected to light exposure for 30 seconds.

Furthermore, after the fabrication of the above-mentioned electrophotographic photoconductors, each photoconductor was charged positively in the dark under the application of +5.3 kV by corona charge, and illuminated by a tungsten lamp with a color temperature of 2856K in such a manner that the illuminance of the illuminated surface of the photoconductor was 45 lux. Such charging and light exposure steps were repeated 5,000 times. After such fatigue, the dynamic electrostatic properties were measured in the same manner as mentioned above.

The results are shown in Table 11.

TABLE 11

| | Electrostatic Properties (Initial stage) | | | Electrostatic Properties (After fatigue) | | |
|---|---|---|---|---|---|---|
| | $V_2$ (−V) | $E_{1/2}$ ($\mu$J/cm$^2$) | $V_r$ (−V) | $V_2$ (−V) | $E_{1/2}$ ($\mu$J/cm$^2$) | $V_r$ (−V) |
| Ex. 19 | 810 | 0.20 | 35 | 830 | 0.21 | 48 |
| Comp. Ex. 7 | 861 | 0.21 | 38 | 987 | 0.26 | 92 |
| Ex. 20 | 740 | 0.35 | 52 | 760 | 0.36 | 60 |
| Comp. Ex. 8 | 798 | 0.54 | 58 | 1011 | 0.65 | 124 |

EXAMPLE 21

(Fabrication of photoconductor No. 21 comprising a single-layered photoconductive layer]

(Formation of single-layered photoconductive layer)

One part by weight of the crystalline oxytitanyl phthalocyanine pigment prepared in Reference Example 2, 4 parts by weight of polycarbonate resin (Trademark "IUPILON Z200" made by Mitsubishi Gas Chemical Company, Inc.) and 45 parts by weight of tetrahydrofuran were dispersed in a sand mill using 1-mm diameter glass beads for 12 hours, so that a dispersion of charge generation material was prepared.

Thereafter, 7 parts by weight of the positive-hole transport material (D-1), one part by weight of the phenol compound No. 2 (shown in Table 1), 6 parts by weight of polycarbonate resin (Trademark "IUPILON Z200" made by Mitsubishi Gas Chemical Company, Inc.) and 55 parts by weight of tetrahydrofuran were added to the above prepared dispersion of charge generation material, and the obtained mixture was further dispersed. Thus, a coating liquid for a single-layered photoconductive layer was prepared.

The thus prepared photoconductive layer coating liquid was coated on the aluminum-deposited surface of an aluminum deposited PET film with a thickness of 75 $\mu$m, and dried at 110° C. for 10 minutes, whereby a single-layered photoconductive layer with a thickness of 20 $\mu$m was provided on the electroconductive support.

Thus, an electrophotographic photoconductor No. 21 according to the present invention was fabricated.

EXAMPLE 22

The procedure for fabrication of the electrophotographic photoconductor No. 21 in Example 21 was repeated except that the phenol compound No. 2 for use in the photoconductive layer coating liquid in Example 21 was replaced by the phenol compound No. 3 (shown in Table 1).

Thus, an electrophotographic photoconductor No. 22 according to the present invention was fabricated.

EXAMPLE 23

The procedure for fabrication of the electrophotographic photoconductor No. 21 in Example 21 was repeated except that the phenol compound No. 2 for use in the photoconductive layer coating liquid in Example 21 was replaced by the phenol compound No. 12 (shown in Table 1).

Thus, an electrophotographic photoconductor No. 23 according to the present invention was fabricated.

EXAMPLE 24

The procedure for fabrication of the electrophotographic photoconductor No. 21 in Example 21 was repeated except that the phenol compound No. 2 for use in the photoconductive layer coating liquid in Example 21 was replaced by the phenol compound No. 14 (shown in Table 1).

Thus, an electrophotographic photoconductor No. 24 according to the present invention was fabricated.

COMPARATIVE EXAMPLE 9

The procedure for fabrication of the electrophotographic photoconductor No. 21 in Example 21 was repeated except that the phenol compound No. 2 was removed from the formulation for the single-layered photoconductive layer coating liquid employed in Example 21.

Thus, a comparative electrophotographic photoconductor No. 9 was fabricated.

The dynamic electrostatic properties of each of the electrophotographic photoconductors No. 21 to No. 24 according to the present invention and the comparative electrophotographic photoconductor No. 9 were evaluated at the initial stage and after fatigue in the same manner as described in the evaluation for the photoconductors Nos. 11 to 18 according to the present invention and the comparative photoconductors Nos. 4 to 6. In this case, the charging and light exposure steps were repeated 5,000 times.

The results are shown in Table 12.

TABLE 12

| | Electrostatic Properties (Initial stage) | | | Electrostatic Properties (After fatigue) | | |
|---|---|---|---|---|---|---|
| | $V_2$ (−V) | $E_{1/2}$ ($\mu$J/cm$^2$) | $V_r$ (−V) | $V_2$ (−V) | $E_{1/2}$ ($\mu$J/cm$^2$) | $V_r$ (−V) |
| Ex. 21 | 910 | 0.17 | 22 | 890 | 0.18 | 38 |
| Ex. 22 | 860 | 0.15 | 26 | 850 | 0.16 | 42 |
| Ex. 23 | 900 | 0.18 | 20 | 875 | 0.18 | 35 |
| Ex. 24 | 890 | 0.16 | 21 | 860 | 0.17 | 39 |
| Comp. Ex. 9 | 950 | 0.16 | 28 | 815 | 0.25 | 84 |

EXAMPLE 25

[Fabrication of photoconductor No. 25 comprising a laminated photoconductive layer]

(Formation of charge generation layer)

A mixture of 5 parts by weight of a trisazo pigment represented by the following formula (P-1), serving as a charge generation material, 5 parts by weight of a commercially available polyvinyl butyral resin (Trademark "S-Lec BLS", made by Sekisui Chemical Co., Ltd.) and 90 parts by weight of tetrahydrofuran was dispersed in a ball mill for 12 hours. Then, tetrahydrofuran was further added to the above prepared dispersion so that the concentration of the dispersion might reach 2 wt. %. Thus, a coating liquid for a charge generation layer was prepared.

(P-1)

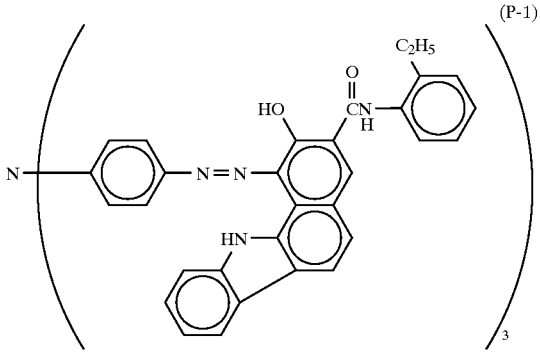

The thus prepared charge generation layer coating liquid was coated on an aluminum plate serving as an electroconductive support using a doctor blade by cast coating method, and dried. Thus, a charge generation layer with a thickness of 0.5 $\mu$m was provided on the electroconductive support.

(Formation of charge transport layer)

A mixture of 202.5 g of tetrahydrofuran, 25.0 g of Z type polycarbonate (made by Teijin Chemicals Ltd.) and 5.0 g of 0.1 wt. % tetrahydrofuran solution of a commercially available silicone oil (Trademark "KF50", made by Shin-Etsu Chemical Co., Ltd.) was stirred at room temperature, so that a Z type polycarbonate solution was prepared.

9.3 g of the above-mentioned Z type polycarbonate solution was added to a mixture of 0.7 g of a positive-hole transport material represented by the following formula (D-1) and 39 mg of the phenol compound No. 102 (shown in Table 2). The obtained mixture was stirred at room temperature to prepare a coating liquid for a charge transport layer.

(D-1)

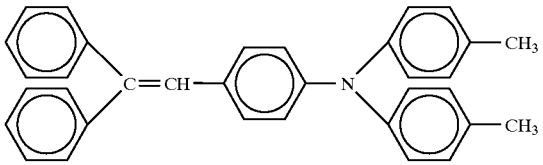

The thus prepared charge transport layer coating liquid was coated on the above prepared charge generation layer using a doctor blade and dried, so that a charge transport layer with a thickness of 20 $\mu$m was provided on the charge generation layer.

Thus, an electrophotographic photoconductor No. 25 according to the present invention was fabricated.

EXAMPLE 26

The procedure for fabrication of the electrophotographic photoconductor No. 25 in Example 25 was repeated except that the phenol compound No. 102 for use in the charge transport layer coating liquid in Example 25 was replaced by the phenol compound No. 103 (shown in Table 2).

Thus, an electrophotographic photoconductor No. 26 according to the present invention was fabricated.

EXAMPLE 27

The procedure for fabrication of the electrophotographic photoconductor No. 25 in Example 25 was repeated except that the phenol compound No. 102 for use in the charge transport layer coating liquid in Example 25 was replaced by the phenol compound No. 105 (shown in Table 2).

Thus, an electrophotographic photoconductor No. 27 according to the present invention was fabricated.

EXAMPLE 28

The procedure for fabrication of the electrophotographic photoconductor No. 25 in Example 25 was repeated except that the phenol compound No. 102 for use in the charge transport layer coating liquid in Example 25 was replaced by the phenol compound No. 107 (shown in Table 2).

Thus, an electrophotographic photoconductor No. 28 according to the present invention was fabricated.

COMPARATIVE EXAMPLE 10

The procedure for fabrication of the electrophotographic photoconductor No. 25 in Example 25 was repeated except that the phenol compound No. 102 was removed from the formulation for the charge transport layer coating liquid employed in Example 25.

Thus, a comparative electrophotographic photoconductor No. 10 was fabricated.

Each of the electrophotographic photoconductors No. 25 to No. 28 according to the present invention and the comparative electrophotographic photoconductor No. 10 was charged negatively in the dark under application of −18 $\mu$A of corona charge for 20 seconds using a commercially available electrostatic copying sheet testing apparatus "Paper Analyzer Model EPA-8100" (Trademark), made by Kawaguchi Electro Works Co., Ltd.

Then, each photoconductor was allowed to stand in the dark for 20 seconds without applying any charge thereto, and the surface potential Vo (−V) of the photoconductor was measured.

Each photoconductor was then illuminated by a monochromatic light of 780 nm in such a manner that the illuminance of the illuminated surface of the photoconductor was 5 $\mu$W/cm$^2$, and the exposure $E_{1/2}$ ($\mu$J/cm$^2$) required to reduce the initial surface potential Vo (−V) to ½ the initial surface potential Vo (−V) was measured.

In addition, after each photoconductor was illuminated by the above-mentioned monochromatic light of 780 nm for 30 seconds, the surface potential Vr (−V) of the photoconductor was measured.

Furthermore, after fabrication of the above-mentioned electrophotographic photoconductors, each photoconductor was exposed to $NO_x$ gas ($NO:NO_2$=4:1) in a concentration of 50 ppm at room temperature for 4 days in an exposure test apparatus.

After the exposure to $NO_x$ for 4 days, the initial surface potential Vo (−V), the exposure $E_{1/2}$ ($\mu$J/cm$^2$), and the residual potential Vr (−V) were measured in the same manner as mentioned above.

The results are shown in Table 13.

TABLE 13

| | Before Exposure to $NO_x$ | | | After Exposure to $NO_x$ | | |
|---|---|---|---|---|---|---|
| | $V_o$ (−V) | $E_{1/2}$ ($\mu$J/cm$^2$) | $V_r$ (−V) | $V_o$ (−V) | $E_{1/2}$ ($\mu$J/cm$^2$) | $V_r$ (−V) |
| Ex. 25 | 1010 | 0.40 | 0 | 960 | 0.42 | 0 |
| Ex. 26 | 1030 | 0.42 | 0 | 920 | 0.45 | 0 |
| Ex. 27 | 980 | 0.45 | 0 | 880 | 0.50 | 0 |
| Ex. 28 | 1050 | 0.48 | 0 | 990 | 0.50 | 0 |
| Comp. Ex. 10 | 1010 | 0.41 | 0 | 320 | 0.31 | 0 |

EXAMPLE 29

[Fabrication of photoconductor No. 29 comprising a laminated photoconductive layer]

(Formation of charge generation layer)

A mixture of 5 parts by weight of an X-type metal-free phthalocyanine pigment serving as a charge generation material, 5 parts by weight of a commercially available polyvinyl butyral resin (Trademark "S-Lec BLS", made by Sekisui Chemical Co., Ltd.) and 90 parts by weight of tetrahydrofuran was dispersed in a ball mill for 12 hours. Then, tetrahydrofuran was further added to the above prepared dispersion so that the concentration of the dispersion might reach 2 wt. %. Thus, a coating liquid for a charge generation layer was prepared.

The thus prepared charge generation layer coating liquid was coated on an aluminum plate serving as an electroconductive support using a doctor blade by cast coating method, and dried. Thus, a charge generation layer with a thickness of 0.5 $\mu$m was provided on the electroconductive support.

(Formation of charge transport layer)

A mixture of 8 parts by weight of an electron-transport material represented by the following formula (A-1), one part by weight of the phenol compound No. 102 (shown in Table 2), 12 parts by weight of Z type polycarbonate (made by Teijin Chemicals Ltd.), and 0.02 parts by weight of a commercially available silicone oil (Trademark "KF50", made by Shin-Etsu Chemical Co., Ltd.) was dissolved in 90 parts by weight of tetrahydrofuran, so that a coating liquid for a charge transport layer was prepared.

(A-1)

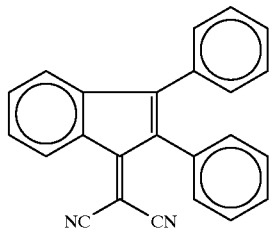

The thus prepared charge transport layer coating liquid was coated on the above prepared charge generation layer using a doctor blade and dried, so that a charge transport layer with a thickness of 20 $\mu$m was provided on the charge generation layer.

Thus, an electrophotographic photoconductor No. 29 according to the present invention was fabricated.

EXAMPLE 30

The procedure for fabrication of the electrophotographic photoconductor No. 29 in Example 29 was repeated except that the phenol compound No. 102 for use in the charge transport layer coating liquid in Example 29 was replaced by the phenol compound No. 103 (shown in Table 2).

Thus, an electrophotographic photoconductor No. 30 according to the present invention was fabricated.

COMPARATIVE EXAMPLE 11

The procedure for fabrication of the electrophotographic photoconductor No. 29 in Example 29 was repeated except that the phenol compound No. 102 was removed from the formulation for the charge transport layer coating liquid employed in Example 29.

Thus, a comparative electrophotographic photoconductor No. 11 was fabricated.

Each of the electrophotographic photoconductors No. 29 and No. 30 according to the present invention and the comparative electrophotographic photoconductor No. 11 was charged positively in the dark under application of +5.3 kV of corona charge for 20 seconds using a commercially available electrostatic copying sheet testing apparatus "Paper Analyzer Model EPA-8200" (Trademark), made by Kawaguchi Electro Works Co., Ltd.

Then, each photoconductor was allowed to stand in the dark for 20 seconds without applying any charge thereto, and the surface potential Vo (V) of the photoconductor was measured.

Each photoconductor was then illuminated by a monochromatic light of 780 nm in such a manner that the illuminance of the illuminated surface of the photoconductor was 5 $\mu W/cm^2$, and the exposure $E_{1/2}$ ($\mu J/cm^2$) required to reduce the initial surface potential Vo (V) to ½ the initial surface potential Vo (V) was measured.

In addition, after each photoconductor was illuminated by the above-mentioned monochromatic light of 780 nm for 30 seconds, the surface potential Vr (V) of the photoconductor was measured.

Furthermore, after fabrication of the above-mentioned electrophotographic photoconductors, each photoconductor was exposed to $NO_x$ gas ($NO:NO_2$=4:1) in a concentration of 50 ppm at room temperature for 4 days in an exposure test apparatus.

After the exposure to $NO_x$ for 4 days, the initial surface potential Vo (V), the exposure $E_{1/2}$ ($\mu J/cm^2$), and the residual potential Vr (V) were measured in the same manner as mentioned above.

The results are shown in Table 14.

TABLE 14

| | Before Exposure to $NO_x$ | | | After Exposure to $NO_x$ | | |
|---|---|---|---|---|---|---|
| | $V_o$ (V) | $E_{1/2}$ ($\mu J/cm^2$) | $V_r$ (V) | $V_o$ (V) | $E_{1/2}$ ($\mu J/cm^2$) | $V_r$ (V) |
| Ex. 29 | 1155 | 1.00 | 30 | 1192 | 1.05 | 35 |
| Ex. 30 | 1200 | 1.05 | 33 | 1255 | 1.10 | 40 |
| Comp. Ex. 11 | 1184 | 0.98 | 30 | 1217 | 1.37 | 61 |

EXAMPLE 31

[Fabrication of photoconductor No. 31 comprising a single-layered photoconductive layer]

(Formation of single-layered photoconductive layer)

1 g of an X-type metal-free phthalocyanine pigment, 10 g of 10 wt. % tetrahydrofuran solution of Z type polycarbonate (made by Teijin Chemicals Ltd.), and 9 g of tetrahydrofuran were pulverized and kneaded overnight in a ball mill pot. To the above prepared mixture, 20 g of 20 wt. % tetrahydrofuran solution of Z type polycarbonate (made by Teijin Chemicals Ltd.) was added, and the thus obtained mixture was further dispersed and kneaded overnight, so that a dispersion of charge generation material was prepared.

0.45 g of the same positive-hole transport material represented by the formula (D-1) as employed in Example 25, 25 mg of the phenol compound No. 102 (shown in Table 2) were put in a container. To this mixture, 1.2 g of the previously prepared 10% dispersion of charge generation material, 0.15 g of 1 wt. % tetrahydrofuran solution of a commercially available silicone oil (Trademark "KF50", made by Shin-Etsu Chemical Co., Ltd.), 1.03 g of tetrahydrofuran, and 4.7 g of 15 wt. % tetrahydrofuran solution of Z type polycarbonate (made by Teijin Chemicals Ltd.) were added. The resultant mixture was stirred at room temperature, whereby a coating liquid for a photoconductive layer was prepared.

The thus prepared photoconductive layer coating liquid was coated on an aluminum plate serving as an electroconductive support by a doctor blade and dried, so that a single-layered photoconductive layer with a thickness of 20 $\mu$m was provided on the support.

Thus, an electrophotographic photoconductor No. 31 according to the present invention was fabricated.

EXAMPLE 32

The procedure for fabrication of the electrophotographic photoconductor No. 31 in Example 31 was repeated except that the phenol compound No. 102 for use in the single-layered photoconductive layer coating liquid in Example 31 was replaced by the phenol compound No. 103 (shown in Table 2).

Thus, an electrophotographic photoconductor No. 32 according to the present invention was fabricated.

EXAMPLE 33

The procedure for fabrication of the electrophotographic photoconductor No. 31 in Example 31 was repeated except that the phenol compound No. 102 for use in the single-layered photoconductive layer coating liquid in Example 31 was replaced by the phenol compound No. 105 (shown in Table 2).

Thus, an electrophotographic photoconductor No. 33 according to the present invention was fabricated.

EXAMPLE 34

The procedure for fabrication of the electrophotographic photoconductor No. 31 in Example 31 was repeated except that the phenol compound No. 102 for use in the single-layered photoconductive layer coating liquid in Example 31 was replaced by the phenol compound No. 107 (shown in Table 2).

Thus, an electrophotographic photoconductor No. 34 according to the present invention was fabricated.

COMPARATIVE EXAMPLE 12

The procedure for fabrication of the electrophotographic photoconductor No. 31 in Example 31 was repeated except that the phenol compound No. 102 was removed from the formulation for the single-layered photoconductive layer coating liquid employed in Example 31.

Thus, a comparative electrophotographic photoconductor No. 12 was fabricated.

Each of the electrophotographic photoconductors No. 31 to No. 34 according to the present invention and the comparative electrophotographic photoconductor No. 12 was charged negatively in the dark under application of −18 $\mu$A of corona charge for 20 seconds using a commercially available electrostatic copying sheet testing apparatus "Paper Analyzer Model EPA-8100" (Trademark), made by Kawaguchi Electro Works Co., Ltd.

Then, each photoconductor was allowed to stand in the dark for 20 seconds without applying any charge thereto, and the surface potential Vo (−V) of the photoconductor was measured.

Each photoconductor was then illuminated by a monochromatic light of 780 nm in such a manner that the illuminance of the illuminated surface of the photoconductor was 5 $\mu$W/cm$^2$, and the exposure $E_{1/2}$ ($\mu$J/cm$^2$) required to reduce the initial surface potential Vo (−V) to ½ the initial surface potential Vo (−V) was measured.

In addition, after each photoconductor was illuminated by the above-mentioned monochromatic light of 780 nm for 30 seconds, the surface potential Vr (−V) of the photoconductor was measured.

Furthermore, after fabrication of the above-mentioned electrophotographic photoconductors, each photoconductor was exposed to $NO_x$ gas ($NO:NO_2$=4:1) in a concentration of 50 ppm at room temperature for 4 days in an exposure test apparatus.

After the exposure to $NO_x$ for 4 days, the initial surface potential Vo (−V), the exposure $E_{1/2}$ ($\mu$J/cm$^2$), and the residual potential Vr (−V) were measured in the same manner as mentioned above.

The results are shown in Table 15.

TABLE 15

| | Before Exposure to $NO_x$ | | | After Exposure to $NO_x$ | | |
|---|---|---|---|---|---|---|
| | $V_o$ (−V) | $E_{1/2}$ ($\mu$J/cm$^2$) | $V_r$ (−V) | $V_o$ (−V) | $E_{1/2}$ ($\mu$J/cm$^2$) | $V_r$ (−V) |
| Ex. 31 | 880 | 0.83 | 2 | 705 | 1.23 | 2 |
| Ex. 32 | 852 | 0.78 | 1 | 798 | 1.09 | 0 |
| Ex. 33 | 795 | 0.85 | 1 | 730 | 1.32 | 1 |
| Ex. 34 | 806 | 0.80 | 3 | 753 | 1.15 | 2 |
| Comp. Ex. 12 | 840 | 0.78 | 2 | 380 | 1.83 | 1 |

As previously explained, when the photoconductive layer comprises the phenol compound represented by formula (1), the chemical durability of the photoconductor is improved.

Japanese Patent Application No. 08-304018 filed on Oct. 30, 1996, Japanese Patent Application No. 08-307393 filed on Nov. 1, 1996, Japanese Patent Application No. 09-043124 filed on Jan. 28, 1997, and Japanese Patent Application No. 09-197916 filed on Jul. 8, 1997 are hereby incorporated by reference.

What is claimed is:

1. An electrophotographic photoconductor comprising an electroconductive support and a photoconductive layer provided thereon, comprising at least one phenol compound of formula (1):

(1)

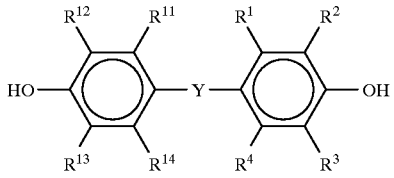

wherein $R^1$ to $R^4$ and $R^{11}$ to $R^{14}$ are each independently a hydrogen atom, an alkyl group which may have a substituent, an alkoxyl group which may have a substituent, an alkoxycarbonyl group which may have a substituent, an aryl group which may have a substituent, nitro group, cyano group or a halogen atom; and Y is

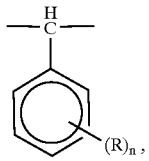

in which R is a hydrogen atom, an alkyl group which may have a substituent, an alkoxyl group which may have a substituent, an alkoxycarbonyl group which may have a substituent, an aryl group which may have a substituent, nitro group, cyano group, hydroxyl group or a halogen atom, and n is an integer of 0 to 5 , or —(CH═CH)$_x$—, in which x is an integer of 0 to 5, wherein when only one phenol compound of formula (1) is present, said phenol compound is not 4,4'-butylidene-bis(3-methyl-6-tert-butylphenol).

2. The electrophotographic photoconductor as claimed in claim 1, wherein said alkyl group represented by $R^1$ to $R^4$, $R^{11}$ to $R^{14}$, and R has 1 to 9 carbon atoms.

3. The electrophotographic photoconductor as claimed in claim 1, wherein said alkoxyl group represented by $R^1$ to $R^4$, $R^{11}$ to $R^{14}$, and R has 1 to 9 carbon atoms.

4. The electrophotographic photoconductor as claimed in claim 1, wherein said alkoxycarbonyl group represented by $R^1$ to $R^4$, $R^{11}$ to $R^{14}$, and R has 1 to 9 carbon atoms.

5. The electrophotographic photoconductor as claimed in claim 1, wherein said phenol compound is represented by formula (2):

(2)

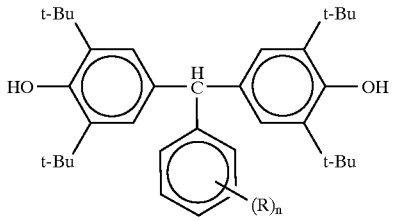

wherein R is a hydrogen atom, an alkyl group which may have a substituent, an alkoxyl group which may have a substituent, an alkoxycarbonyl group which may have a substituent, an aryl group which may have a substituent, nitro group, cyano group, hydroxyl group, or a halogen atom; and n is an integer of 0 to 5.

6. The electrophotographic photoconductor as claimed in claim 1, wherein said phenol compound is represented by formula (3):

(3)

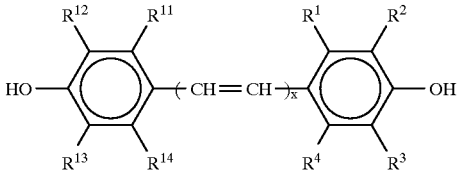

wherein $R^1$ to $R^4$ and $R^{11}$ to $R^{14}$ are each a hydrogen atom, an alkyl group which may have a substituent, an alkoxyl group which may have a substituent, an alkoxycarbonyl group which may have a substituent, an aryl group which may have a substituent, nitro group, cyano group, or a halogen atom; and x is an integer of 0 to 5.

7. The electrophotographic photoconductor as claimed in claim 1, wherein said photoconductive layer comprises a charge generation layer comprising a charge generation material, and a charge transport layer comprising a charge transport material and said phenol compound of formula (1), said charge generation layer and said charge transport layer being successively provided on said electroconductive support.

8. The electrophotographic photoconductor as claimed in claim 1, wherein said photoconductive layer comprises a charge generation material, a charge transport material, and said phenol compound of formula (1) .

9. The electrophotographic photoconductor as claimed in claim 7, wherein said charge transport material comprises a positive-hole transport material.

10. The electrophotographic photoconductor as claimed in claim 9, wherein said positive-hole transport material comprises a stilbene compound of formula (4):

(4)

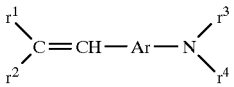

wherein $r^1$ and $r^2$ are each a hydrogen atom, an alkyl group which may have a substituent, an alkoxyl group which may have a substituent or an aryl group which may have a substituent, and $r^1$ and $r^2$ in combination may form a ring; $r^3$ and $r^4$ are each a hydrogen atom, an alkyl group which may have a substituent, an alkoxyl group which may have a substituent, an aryl group which may have a substituent or a heterocyclic group which may have a substituent; and Ar is an arylene group which may have a substituent.

11. The electrophotographic photoconductor as claimed in claim 8, wherein said charge transport material comprises a positive-hole transport material.

12. The electrophotographic photoconductor as claimed in claim 11, wherein said positive-hole transport material comprises a stilbene compound of formula (4):

(4)

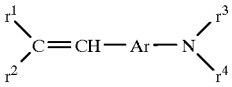

wherein $r^1$ and $r^2$ are each a hydrogen atom, an alkyl group which may have a substituent, an alkoxyl group which may have a substituent or an aryl group which may have a substituent, and $r^1$ and $r^2$ in combination may form a ring; $r^3$ and $r^4$ are each a hydrogen atom, an alkyl group which may have a substituent, an alkoxyl group which may have a substituent, an aryl group which may have a substituent or a heterocyclic group which may have a substituent; and Ar is an arylene group which may have a substituent.

13. The electrophotographic photoconductor as claimed in claim 7, wherein said charge transport material comprises an electron-transport material.

14. The electrophotographic photoconductor as claimed in claim 13, wherein said electron-transport material comprises (2,3-diphenyl-1-indenylidene)-malononitrile of formula (5):

(5)

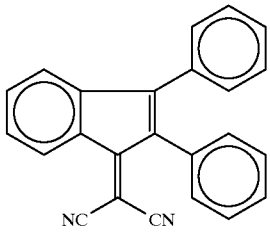

15. The electrophotographic photoconductor as claimed in claim 8, wherein said charge transport material comprises an electron-transport material.

16. The electrophotographic photoconductor as claimed in claim 15, wherein said electron-transport material comprises (2,3-diphenyl-1-indenylidene)-malononitrile of formula (5):

(5)

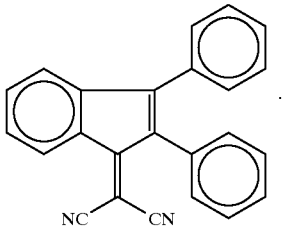

17. The electrophotographic photoconductor as claimed in claim 7, wherein said charge generation material comprises a phthalocyanine compound.

18. The electrophotographic photoconductor as claimed in claim 17, wherein said phthalocyanine compound comprises an oxytitanyl phthalocyanine pigment.

19. The electrophotographic photoconductor as claimed in claim 8, wherein said charge generation material comprises a phthalocyanine compound.

20. The electrophotographic photoconductor as claimed in claim 19, wherein said phthalocyanine compound comprises an oxytitanyl phthalocyanine pigment.

21. The electrophotographic photoconductor as claimed in claim 1, wherein Y in said phenol compound is

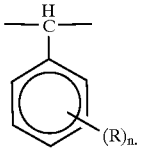

22. The electrophotographic photoconductor as claimed in claim 6, wherein x is 0, 1, 3, 4, or 5.

23. The electrophotographic photoconductor as claimed in claim 6, wherein x is 2, $R^2$, $R^3$, $R^{12}$ and $R^{13}$ are each H, and $R^1$, $R^4$, $R^{11}$, and $R^{14}$ are each 4-methylphenyl.

* * * * *